US005343110A

United States Patent [19]

Kaneko et al.

[11] Patent Number: 5,343,110

[45] Date of Patent: Aug. 30, 1994

[54] ELECTRON EMISSION ELEMENT

[75] Inventors: Akira Kaneko, Tokyo; Toru Kanno; Keiko Morishita, both of Kawasaki, all of Japan

[73] Assignee: Matsushita Electric Industrial Co., Ltd., Osaka, Japan

[21] Appl. No.: 889,938

[22] Filed: Jun. 2, 1992

[30] Foreign Application Priority Data

Jun. 4, 1991 [JP] Japan ..... 3-132633
Jan. 27, 1992 [JP] Japan ..... 4-11777
Feb. 20, 1992 [JP] Japan ..... 4-33086

[51] Int. Cl.[5] ..... H01J 1/13; H01J 1/16
[52] U.S. Cl. ..... 313/309; 313/351
[58] Field of Search ..... 313/309, 336, 351

[56] References Cited

U.S. PATENT DOCUMENTS 4,683,399 7/1987 Soclof ..... 313/336 X
4,827,177 5/1989 Lee et al. .
4,855,636 8/1989 Busta et al. .
5,144,191 9/1992 Jones et al. ..... 313/336 X
5,214,346 5/1993 Komatsu ..... 313/309

FOREIGN PATENT DOCUMENTS 349129 3/1991 Japan .

OTHER PUBLICATIONS

"Lateral cold cathode triode structures fabricated on insulating substrates" by H. H. Busta, Inst. Plys. Conf. Ser. No. 99: Section 2, Paper presented at 2nd Int. Conf. on Vac. Microelectron., Bath 1989.

"Observation and Control of Liquid Crystal Molecules by STM", Densoken News No. 493, Feb., 1991 (w/ English translation).

*Primary Examiner*—Sandra L. O'Shea
*Attorney, Agent, or Firm*—Lowe, Price, LeBlanc & Becker

[57] ABSTRACT

An electron emission element includes a substrate, a base electrode formed on the substrate, an emitter connecting portion formed on a part of the base electrode, and an emitter formed on the emitter connecting portion and having a wedge. The wedge of the emitter has a mesa shape in section. The wedge of the emitter has an upper surface and a lower surface which is wider than the upper surface. The wedge of the emitter has an edge provided with a lower corner of an acute angle in section. The electron emission element further includes an insulating layer formed on the substrate and spaced from the wedge of the emitter by a given gap, and a control electrode formed on the insulating layer for enabling electrons to be emitted from the edge of the emitter. The wedge of the emitter may have an inverted-mesa shape.

22 Claims, 20 Drawing Sheets

ELECTRON EMISSION ELEMENT

BACKGROUND OF THE INVENTION

This invention relates to an electron emission element usable in various apparatus such as an electron microscope, an electron beam exposure apparatus, a cathode-ray tube (CRT), or other electron beam apparatus.

Recently, electron emission elements dispensing with a heating process have been widely studied. Typical examples of such electron emission elements are field emitters and micro-field-emitters.

A general field emitter includes an emitter tip which is made into a needle shape so as to have a curvature radius of several hundreds of nanometers or smaller. An electric field having a strength of about $10^7$ V/cm is concentrated on the emitter tip, forcing electrons to be emitted from the emitter tip. Such a field emitter has advantages, that is, (1) a high current density and (2) a low power consumption.

As will be explained later, a background-art electron emission element has some problem.

SUMMARY OF THE INVENTION

It is an object of this invention to provide an improved electron emission element.

A first aspect of this invention provides an electron emission element comprising a substrate; a base electrode formed on the substrate; an emitter connecting portion formed on a part of the base electrode; an emitter formed on the emitter connecting portion and having a wedge, the wedge having a mesa shape in section, the wedge having an upper surface and a lower surface which is wider than the upper surface, the wedge having an edge which has a lower corner of an acute angle in section; an insulating layer formed on the substrate and spaced from the wedge of the emitter by a given gap; and a control electrode formed on the insulating layer for enabling electrons to be emitted from the edge of the emitter.

A second aspect of this invention provides an electron emission element comprising a substrate; a base electrode formed on the substrate; an emitter connecting portion formed on a part of the base electrode; an emitter formed on the emitter connecting portion and having a wedge, the wedge having an inverted-mesa shape in section, the wedge having an upper surface and a lower surface which is narrower than the upper surface, the wedge having an edge which has an upper corner of an acute angle in section; an insulating layer formed on the substrate and spaced from the wedge of the emitter by a given gap; and a control electrode formed on the insulating layer for enabling electrons to be emitted from the edge of the emitter.

A third aspect of this invention provides an electron emission element comprising an insulating substrate; a base electrode formed on the insulating substrate; a plurality of emitters formed on the base electrode and arranged radially with respect to a given point, the emitters having respective wedges facing inward; an insulating layer formed on the substrate and the base electrode and spaced from the wedges of the emitters by given gaps; and a control electrode formed on the insulating layer for enabling electrons to be emitted from the wedges of the emitters; wherein each of the wedges has a mesa shape in section, and each of the wedges has an upper surface and a lower surface which is wider than the upper surface, and wherein each of the wedges has an edge which has a lower corner of an acute angle in section.

A fourth aspect of this invention provides an electron emission element comprising an insulating substrate; a base electrode formed on the insulating substrate; a plurality of emitters formed on the base electrode and arranged radially with respect to a given point, the emitters having respective wedges facing inward; an insulating layer formed on the substrate and the base electrode and spaced from the wedges of the emitters by given gaps; and a control electrode formed on the insulating layer for enabling electrons to be emitted from the wedges of the emitters; wherein each of the wedges has an inverted-mesa shape in section, and each of the wedges has an upper surface and a lower surface which is narrower than the upper surface, and wherein each of the wedges has an edge which has an upper corner of an acute angle in section.

A fifth aspect of this invention provides an electron emission element comprising a substrate; a base electrode formed on the substrate; a first emitter connecting portion formed on a part of the base electrode; a second emitter connecting portion formed on the first emitter connecting portion, wherein the first emitter connecting portion and the second emitter connecting portion are made of different materials respectively; an emitter formed on the second emitter connecting portion and having a wedge; an insulating layer formed on the substrate and spaced from the wedge of the emitter by a given gap; and a control electrode formed on the insulating layer for enabling electrons to be emitted from the emitter.

DESCRIPTION OF THE BACKGROUND ART

Before the description of embodiments of this invention, a background-art device will be explained hereinafter for a better understanding of this invention.

Figure 1:
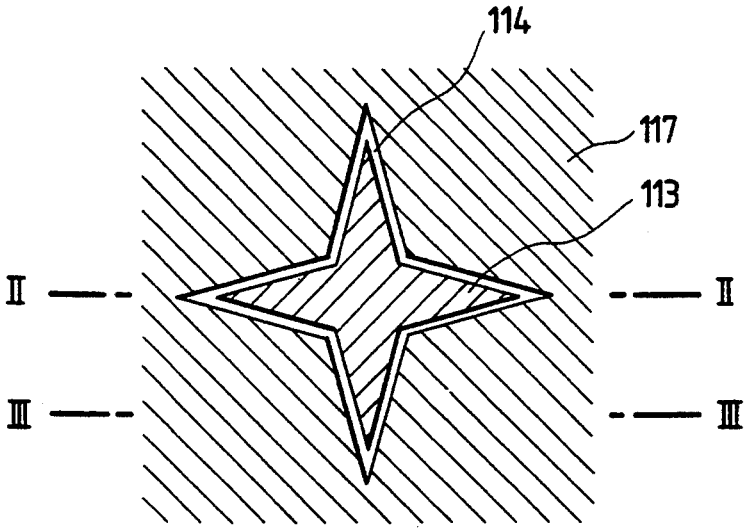
FIG. 1 is a sectional view of a background-art electron emission element.
Figure 2:
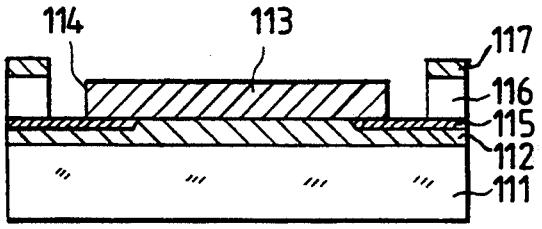
FIG. 2 is a sectional view of the background-art electron emission element, taken along the line II—II of FIG. 1.
Figure 3:
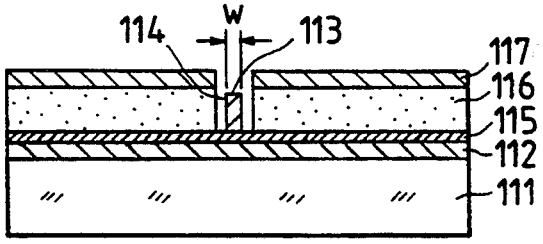
FIG. 3 is a sectional view of the background-art electron emission element, taken along the line III—III of FIG. 1.

With reference to FIGS. 1–3, a background-art electron emission element includes a substrate 111 made of insulating material such as glass. A layer of a base electrode 112 is formed on the substrate 111. An emitter layer 113 is formed on the base electrode 112. A current can flow from the base electrode 112 to the emitter layer 113. The emitter layer 113 is made of suitable material such as Si, ZrC, TiC, Mo, or W which has a low work function and a high melting point.

The emitter layer 113 has a crisscross shape, having four wedge projections with tips 114 which are spaced by equal angular intervals. Each of the projections has a rectangular or trapezoidal cross-section. Each of the projections is tapered at a fixed rate, having a horizontal width W which linearly decreases from a given value to zero in the direction from the center of the crisscross shape to the related tip 114.

An insulating layer 115 is formed on the portion of the base electrode 112 which extends below outer edges of the emitter layer 113 and which extends outward of the emitter layer 113.

An insulating layer 116 is formed on the insulating layer 115. The insulating layer 116 is horizontally spaced from the emitter layer 113 by a given gap. Specifically, the insulating layer 116 is provided with a recess having a crisscross shape similar to and slightly greater than the crisscross shape of the emitter layer 113, and the emitter layer 113 is located in the recess of the insulating layer 116. The recess of the insulating layer 116 has tapered portions conforming to the tapered projections of the emitter layer 113. The insulating layer 116 is made of, for example, $Al_2O_3$ or $SiO_2$. The insulating layer 116 has a thickness equal to or greater than the thickness of the emitter layer 113. A layer of a control electrode 117 is superposed on the insulating layer 116. The control electrode 117 has a crisscross opening with tapered portions conforming to the tapered projections of the emitter layer 113. The control electrode 117 is made of, for example, metal. The control electrode 117 functions to help the emission of electrons from the emitter layer 113.

The electron emission element of FIGS. 1–3 operates as follows. When a voltage is applied between the emitter layer 113 and the control electrode 117 via the base electrode 112 in a manner such that the emitter layer 113 is subjected to a negative potential relative to the control electrode 117, lines of an electric force are concentrated on the tip 114 of each projection of the emitter layer 113 so that a strong electric field is applied to the tip 114. The strong electric field applied to the tip 114 forces electrons to be emitted from the tip 114.

The tapered design of the emitter layer 113 and the corresponding tapered design of the control electrode 117 ensure that a variation in the accuracy of the patterns of the emitter layer 113 and the control electrode 117 can be compensated and thus stable electron emission characteristics can be always maintained.

Since each of the projections of the emitter layer 113 has the rectangular or trapezoidal cross-section, it tends to be difficult to adequately concentrate the electric field on the tip 114 thereof so that the characteristics of the emission of electrons from the tip 114 are sometimes poor.

DESCRIPTION OF THE FIRST PREFERRED EMBODIMENT

Figure 4:
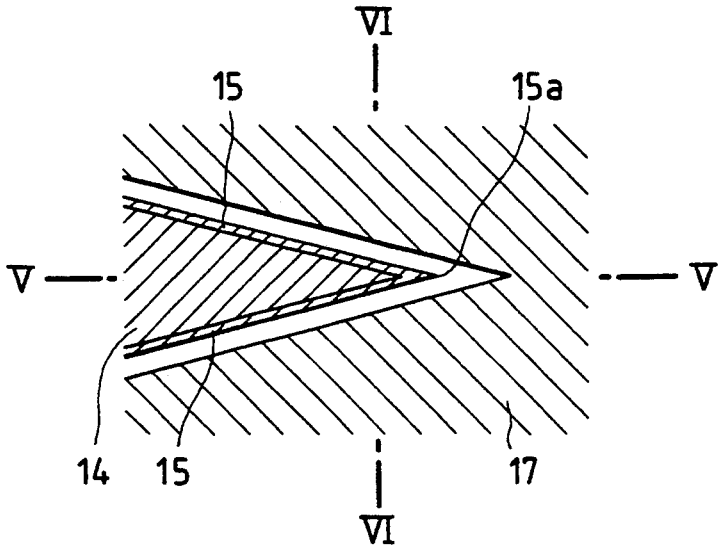
FIG. 4 is a sectional view of an electron emission element according to a first embodiment of this invention.
Figure 5:
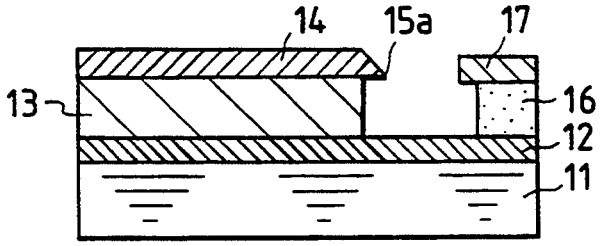
FIG. 5 is a sectional view of the electron emission element, taken along the line V—V of FIG. 4.
Figure 6:
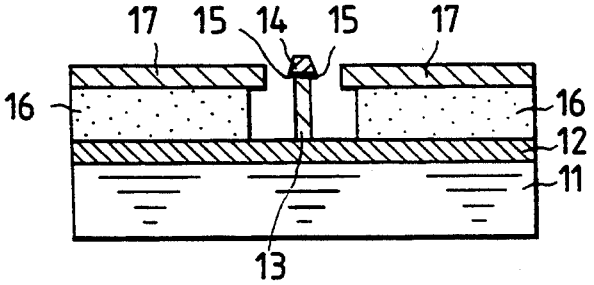
FIG. 6 is a sectional view of the electron emission element, taken along the line VI—VI of FIG. 4.

With reference to FIGS. 4–6, an electron emission element includes a substrate 11 made of insulating material such as glass, $Al_2O_3$, or $SiO_2$. A layer of a base electrode 12 is formed on the substrate 11. The base electrode 12 is made of suitable material such as Al, Cr, Pt, $In_2O_3$, or Ta. An emitter connection layer 13 is formed on a given area of the base electrode 12. The emitter connection layer 13 is made of suitable material such as Au, Cr, C, Si, or Ge. An emitter layer 14 is superposed on the emitter connection layer 13. The emitter layer 14 and the base electrode 12 are electrically connected via the emitter connection layer 13. Thus, a current can flow from the base electrode 12 to the emitter layer 14 via the emitter connection layer 13. The emitter layer 14 is made of suitable material such as Mo, W, ZrC, or $LaB_6$ which has a low work function and a high melting point.

The emitter connection layer 13 has a crisscross shape, having four wedge projections with tips which are spaced by equal angular intervals. Each of the projections of the emitter connection layer 13 has a rectangular or trapezoidal cross-section. Each of the projections of the emitter connection layer 13 is tapered at a fixed rate, having a horizontal width which linearly decreases from a given value to zero in the direction from the center of the crisscross shape to the related tip.

The emitter layer 14 has a crisscross shape similar to but slightly greater than the crisscross shape of the emitter connection layer 13. The emitter layer 14 has four wedge projections with tips which are spaced by equal angular intervals. Each of the projections of the emitter layer 14 has a trapezoidal cross-section. Each of the projections of the emitter layer 14 is tapered at a fixed rate, having a horizontal width which linearly decreases from a given value to zero in the direction from the center of the crisscross shape to the related tip. The cross-section of each of the projections of the emitter layer 14 has such a mesa shape that an upper horizontal dimension is smaller than a lower horizontal dimension. As best shown in FIG. 6, each of the projections of the emitter layer 14 has two edges 15 which slightly extend outward from the emitter connection layer 13 and which have lower corners of a given acute angle in cross-section. The two edges 15 of each projection of the emitter layer 14 intersect and terminate at a vertex or tip 15*a* having a lower corner of a given acute angle. As best shown in FIG. 5, a lower part of each tip 15*a* extends outward from the emitter connection layer 13.

An insulating layer 16 is formed on a given area of the base electrode 12. The insulating layer 16 is horizontally spaced from the emitter layer 14 by a given gap. Specifically, the insulating layer 16 is provided with a recess having a crisscross shape similar to and slightly greater than the crisscross shape of the emitter layer 14, and the emitter layer 14 is located in the recess of the insulating layer 16. The recess of the insulating layer 16 has tapered portions conforming to the tapered projections of the emitter layer 14. The insulating layer 16 is made of suitable material such as $SiO_2$, $Al_2O_3$, or $Si_3N_4$. The insulating layer 16 has a thickness approximately equal to the thickness of the emitter connection layer 13. A layer of a control electrode 17 is superposed on the insulating layer 16. The control electrode 17 has a crisscross opening with tapered portions conforming to the tapered projections of the emitter layer 14. The control electrode 17 is made of metal such as Cr, Mo, or W. The control electrode 17 functions to help the emission of electrons from the emitter layer 14.

The electron emission element of FIGS. 4–6 operates as follows. In the case where a voltage is applied between the emitter layer 14 and the control electrode 17 via the base electrode 12 and the emitter connection layer 13 in a manner such that the emitter layer 14 is subjected to a negative potential relative to the control electrode 17, lines of an electric force are concentrated on the lower acute-angle corner of the tip 15*a* of each projection of the emitter layer 14 so that a strong electric field is applied to the lower acute-angle corner of the tip 15*a*. When the strength of the electric field applied to the lower acute-angle corner of the tip 15*a* exceeds a given strength, electrons are emitted from the lower acute-angle corner of the tip 15*a* due to the tunnel effect.

As described previously, the cross-section of each of the projections of the emitter layer 14 has a mesa shape, and the tip 15*a* of each projection of the emitter layer 14 has the lower acute-angle corner. According to this design of the emitter layer 14, a larger number of lines of an electric force can be concentrated on the lower acute-angle corner of each tip 15*a* so that the electron emission element can operate at a lower applied voltage and that the electron emission characteristics can be improved.

Figure 7:
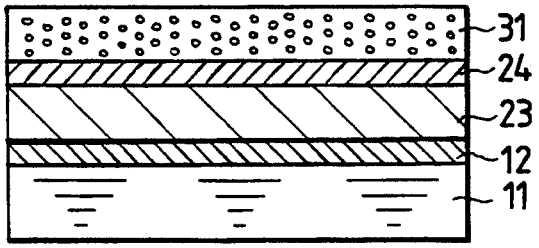
FIGS. 7–12 are sectional views of a substrate and various layers thereon at different phases of the fabrication of the electron emission element of FIGS. 4–6.
Figure 8:
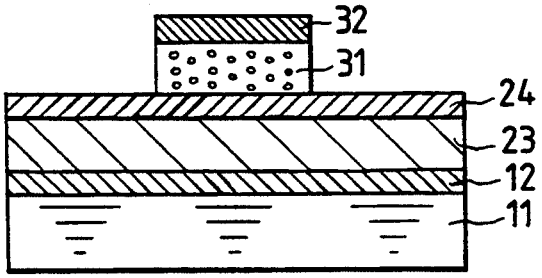
Figure 9:
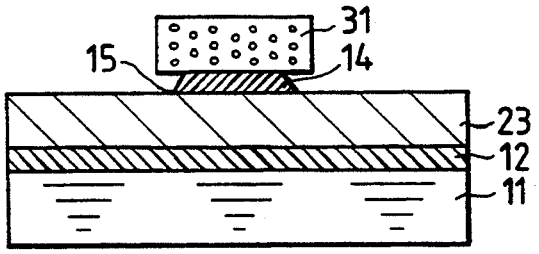
Figure 10:
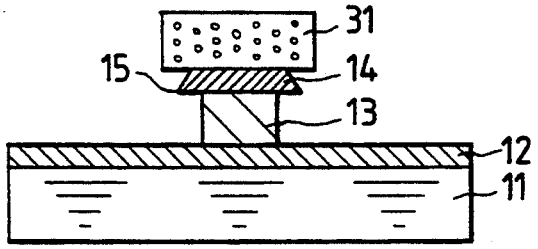
Figure 11:
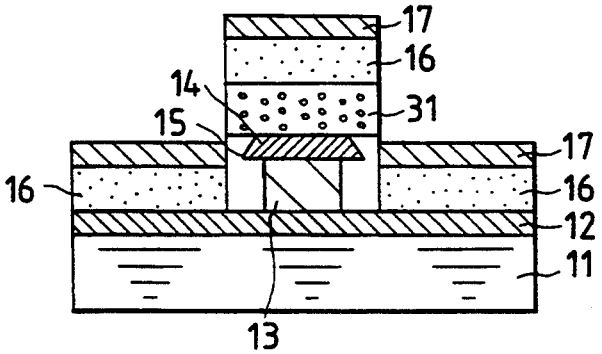
Figure 12:
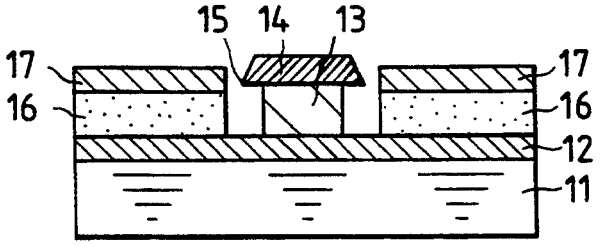

The electron emission element of FIGS. 4–6 was fabricated as follows. First, as shown in FIG. 7, a substrate 11 made of suitable material such as glass, $Al_2O_3$, or $SiO_2$ was prepared. Then, a film of a base electrode 12, an emitter connection film 23, an emitter film 24, and a mask layer 31 were sequentially formed on the substrate 11 by a suitable method such as a vapor deposition method. The base electrode film 12 was made of suitable material such as Cr, Pt, $In_2O_3$, or Ta. The emitter connection film 23 was made of suitable material such as Au, C, Cr, Si, or Ge. The emitter film 24 was made of suitable material such as Mo or W. The mask layer 31 was made of suitable material such as Al or $SiO_2$. Subsequently, as shown in FIG. 8, a resist 32 was formed on the mask layer 31 by a general lithography technique. The resist 32 had a pattern essentially corresponding to the shape of a final emitter layer 14. The portions of the mask layer 31 which were uncovered from the resist 32 were removed by an etching process while the resist 32 was used as a mask. The resist 32 was removed. Then, as shown in FIG. 9, the emitter film 24 was made into a shape slightly smaller than the shape of the remainder of the mask layer 31 by a reactive ion etching process using, for example, $CF_4$-based gas. During this etching process, the remainder of the mask layer 31 was used as a mask member. As a result, the emitter film 24 was processed into a final emitter layer 14. The etching process was kept in isotropic conditions so that the cross-section of the final emitter layer 14 had a mesa shape in which an upper horizontal dimension was smaller than a lower horizontal dimension. In addition, the final emitter layer 14 was formed with edges 15 which had lower corners of a given acute angle in cross-section. Also, the final emitter layer 14 was formed with tips 15*a* (see FIGS. 4 and 5) each having a lower corner of a given acute angle. It was preferable that the emitter connection film 23 was made of material able to withstand the $CF_4$-based gas. Subsequently, as shown in FIG. 10, the emitter connection film 23 was made into a shape slightly smaller than the shape of the final emitter layer 14 by an etching process using, for example, $Cl_2$-based gas. During this etching process, the remainder of the mask layer 31 and the final emitter layer 14 were used as a mask member. As a result, the emitter connection film 23 was processed into a final emitter connection layer 13. The edges 15 and the tips 15*a* (see FIGS. 4 and 5) of the final emitter layer 14 extended outward from the final emitter connection layer 13. It was preferable that the emitter connection film 23 was made of material able to withstand the $Cl_2$-based gas. Next, as shown in FIG. 11, an insulating layer 16 and a layer of a control electrode 17 were sequentially formed on the exposed portions of the abovementioned layers on the substrate 11 by a suitable method such as a vapor deposition method. The insulating layer 16 was made of suitable material such as $SiO_2$, $Al_2O_3$, or $Si_3N_4$. The layer of the control electrode 17 was made of metal such as Cr, Mo, or W. Finally, as shown in FIG. 12, the remainder of the mask layer 31, and the portions of the insulating layer 16 and the control electrode layer 17 extending thereon were removed so that the emitter layer 14 was exposed. The remainders of the insulating layer 16 and the control electrode layer 17 were horizontally spaced from the emitter layer 14 by a given gap.

As described previously, the emitter layer 14 is made of suitable material such as Mo, W, ZrC, or $LaB_6$ while the emitter connection layer 13 is made of suitable material such as Au, Cr, C, Si, or Ge which differs from the material constituting the emitter layer 14. This choice of the materials constituting the emitter layer 14 and the emitter connection layer 13 enables the easy formation of a sharp structure of the edges 15 of the emitter layer 14. In the case where the emitter connection layer 13 is made of semiconductor material such as Si or Ge, the resistance of the emitter connection layer 13 presents an excessive current resulting from the emission of electrons at an excessive rate.

DESCRIPTION OF THE SECOND PREFERRED EMBODIMENT

Figure 13:
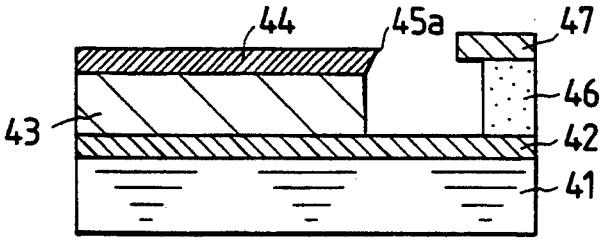
FIG. 13 is a sectional view similar to that of FIG. 5 and shows an electron emission element according to a second embodiment of this invention.
Figure 14:
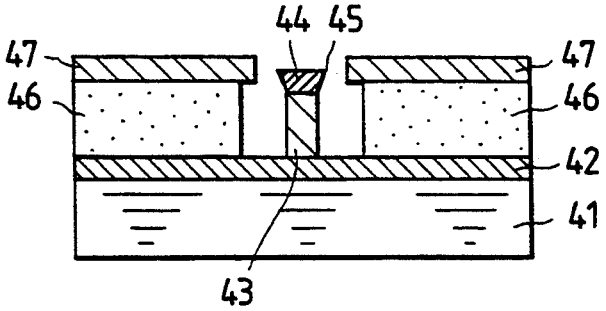
FIG. 14 is a sectional view similar to that of FIG. 6 and shows the electron emission element according to the second embodiment.

With reference to FIGS. 13 and 14, an electron emission element includes a substrate 41 made of insulating material such as glass, $Al_2O_3$, or $SiO_2$. A layer of a base electrode 42 is formed on the substrate 41. The base electrode 42 is made of suitable material such as Al, Cr, Pt, $In_2O_3$, or Ta. An emitter connection layer 43 is formed on a given area of the base electrode 42. The emitter connection layer 43 is made of suitable material such as Au, Cr, C, Si, or Ge. An emitter layer 44 is superposed on the emitter connection layer 43. The emitter layer 44 and the base electrode 42 are electrically connected via the emitter connection layer 43. Thus, a current can flow from the base electrode 42 to the emitter layer 44 via the emitter connection layer 43. The emitter layer 44 is made of suitable material such as Mo, W, ZrC, or $LaB_6$ which has a low work function and a high melting point.

The emitter connection layer 43 has a crisscross shape, having four wedge projections with tips which are spaced by equal angular intervals. Each of the projections of the emitter connection layer 43 has a rectangular or trapezoidal cross-section. Each of the projections of the emitter connection layer 43 is tapered at a fixed rate, having a horizontal width which linearly decreases from a given value to zero in the direction from the center of the crisscross shape to the related tip.

The emitter layer 44 has a crisscross shape similar to and slightly greater than the crisscross shape of the emitter connection layer 13. The emitter layer 44 has four wedge projections with tips which are spaced by equal angular intervals. Each of the projections of the emitter layer 44 has a trapezoidal cross-section. Each of the projections of the emitter layer 44 is tapered at a fixed rate, having a horizontal width which linearly decreases from a given value to zero in the direction from the center of the crisscross shape to the related tip. The cross-section of each of the projections of the emitter layer 44 has such an-inverted mesa shape that an upper horizontal dimension is larger than a lower horizontal dimension. As best shown in FIG. 14, each of the projections of the emitter layer 44 has two edges 45 which slightly extend outward from the emitter connection layer 43 and which have upper corners of a given acute angle in cross-section. The two edges 45 of each projection of the emitter layer 44 intersect and terminate at a vertex or tip **45*a* having an upper corner of a given acute angle. As best shown in FIG. 13, an upper part of each tip 45*a* extends outward from the emitter connection layer 43**.

An insulating layer 46 is formed on a given area of the base electrode 42. The insulating layer 46 is horizontally spaced from the emitter layer 44 by a given gap. Specifically, the insulating layer 46 is provided with a recess having a crisscross shape similar to and slightly greater than the crisscross shape of the emitter layer 44, and the emitter layer 44 is located in the recess of the insulating layer 46. The recess of the insulating layer 46 has tapered portions conforming to the tapered projections of the emitter layer 44. The insulating layer 46 is made of suitable material such as $SiO_2$, $Al_2O_3$, or $Si_3N_4$. The insulating layer 46 has a thickness approximately equal to the thickness of the emitter connection layer 43. A layer of a control electrode 47 is superposed on the insulating layer 46. The control electrode 47 has a crisscross opening with tapered portions conforming to the tapered projections of the emitter layer 44. The control electrode 47 is made of metal such as Cr, Mo, or W. The control electrode 47 functions to help the emission of electrons from the emitter layer 44.

The electron emission element of FIGS. 13 and 14 operates as follows. In the case where a voltage is applied between the emitter layer 44 and the control electrode 47 via the base electrode 42 and the emitter connection electrode 43 in a manner such that the emitter layer 44 is subjected to a negative potential relative to the control electrode 47, lines of an electric force are concentrated on the upper acute-angle corner of the tip **45*a* of each projection of the emitter layer 44 so that a strong electric field is applied to the upper acute-angle corner of the tip 45*a*. When the strength of the electric field applied to the upper acute-angle corner of the tip 45*a* exceeds a given strength, electrons are emitted from the upper acute-angle corner of the tip 45*a*** due to the tunnel effect.

As described previously, the cross-section of each of the projections of the emitter layer 44 has an inverted-mesa shape, and the tip **45*a* of each projection of the emitter layer 44 has the upper acute-angle corner. According to this design of the emitter layer 44, a larger number of lines of an electric force can be concentrated on the upper acute-angle corner of each tip 45*a*** so that the electron emission element can operate at a lower applied voltage and that the electron emission characteristics can be improved.

Figure 15:
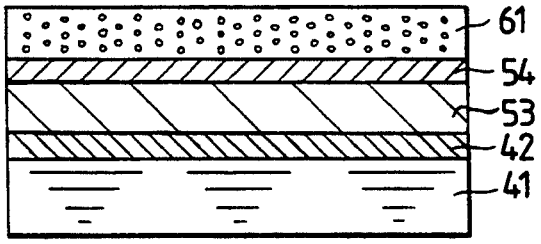
FIGS. 15–21 are sectional views of a substrate and various layers thereon at different phases of the fabrication of the electron emission element of FIGS. 13 and 14.
Figure 16:
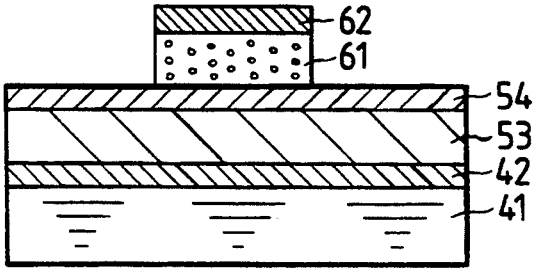
Figure 17:
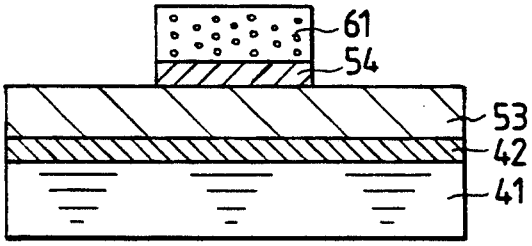
Figure 18:
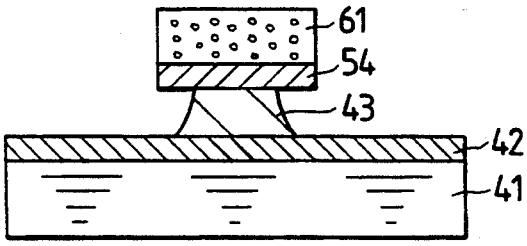
Figure 19:
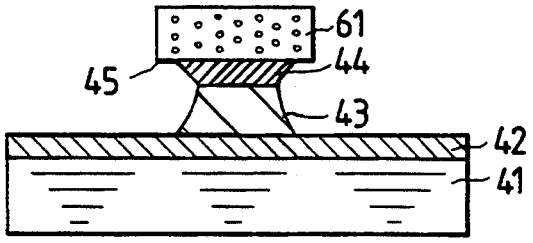
Figure 20:
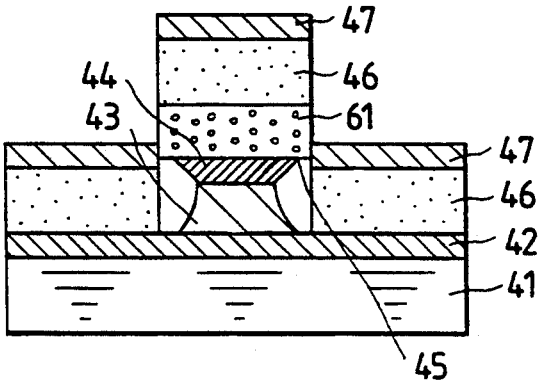
Figure 21:
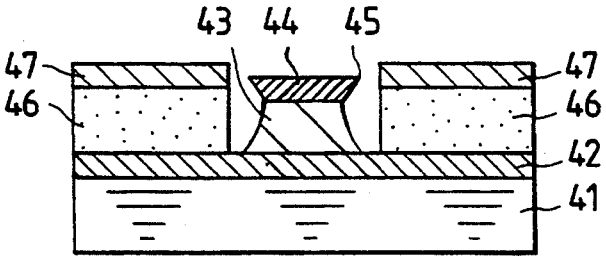

The electron emission element of FIGS. 13 and 14 was fabricated as follows. First, as shown in FIG. 15, a substrate 41 made of suitable material such as glass, $Al_2O_3$, or $SiO_2$ was prepared. Then, a film of a base electrode 42, an emitter connection film 53, an emitter film 54, and a mask layer 61 were sequentially formed on the substrate 41 by a suitable method such as a vapor deposition method. The base electrode film 42 was made of suitable material such as Cr, Pt, $In_2O_3$, or Ta. The emitter connection film 53 was made of suitable material such as An, C, Cr, Si, or Ge. The emitter film 54 was made of suitable material such as Mo or W. The mask layer 61 was made of suitable material such as Al or $SiO_2$. Subsequently, as shown in FIG. 16, a resist 62 was formed on the mask layer 61 by a general lithography technique. The resist 62 had a pattern essentially corresponding to the shape of a final emitter layer 44. The portions of the mask layer 61 which were uncovered from the resist 62 were removed by an etching process while the resist 62 was used as a mask. The resist 62 was removed. Then, as shown in FIG. 17, the emitter film 54 was made into a shape essentially equal to the shape of the remainder of the mask layer 61 by a reactive ion etching process using, for example, $CF_4$-based gas. During this etching process, the remainder of the mask layer 61 was used as a mask member. The etching process was kept in anisotropic conditions. Subsequently, as shown in FIG. 18, the emitter connection film 53 was made into a shape slightly smaller than the shape of the remainder of the emitter film 54 by a reactive ion etching process using, for example, $Cl_2$-based gas. During this etching process, the remainder of the mask layer 61 and the remainder of the emitter film 54 were used as a mask member. As a result, the emitter connection film 54 was processed into a final emitter connection layer 43. The etching process was kept in isotropic conditions so that the cross-section of the final emitter connection layer 43 had a mesa shape in which an upper horizontal dimension is smaller than a lower horizontal dimension. In addition, upper portions of the final emitter connection layer 43 extended inward of the edges of the remainder of the emitter film 54. Next, as shown in FIG. 19, the remainder of the emitter film 54 was further reduced by a reactive ion etching process using, for example, $CF_4$-based gas. As a result, the remainder of the emitter film 54 was processed into a final emitter layer 44. The etching process was kept in isotropic conditions so that the cross-section of the final emitter layer 44 had an inverted-mesa shape in which an upper horizontal dimension was larger than a lower horizontal dimension. In addition, the final emitter layer 44 was formed with edges 45 which had upper corners of a given acute angle in cross-section. Also, the final emitter layer 44 was formed with tips 45*a* (see FIG. 13) each having an upper corner of a given acute angle. The edges 45 and the tips 45*a* (see FIGS. 13 and 14) of the final emitter layer 44 extended outward from the final emitter connection layer 43. Subsequently, as shown in FIG. 20, an insulating layer 46 and a layer of a control electrode 47 were sequentially formed on the exposed portions of the abovementioned layers on the substrate 41 by a suitable method such as a vapor deposition method. The insulating layer 46 was made of suitable material such as $SiO_2$, $Al_2O_3$, or $Si_3N_4$. The layer of the control electrode 47 was made of metal such as Cr, Mo, or W. Finally, as shown in FIG. 21, the remainder of the mask layer 61, and the portions of the insulating layer 46 and the control electrode layer 47 extending thereon were removed so that the emitter layer 44 was exposed. The remainders of the insulating layer 46 and the control electrode layer 47 were horizontally spaced from the emitter layer 44 by a given gap.

As described previously, the emitter layer 44 is made of suitable material such as Mo, W, ZrC, or $LaB_6$ while the emitter connection layer 43 is made of suitable material such as Au, Cr, C, Si, or Ge which differs from the material constituting the emitter layer 44. This choice of the materials constituting the emitter layer 44 and the emitter connection layer 43 enables the easy formation of a sharp structure of the edges 45 of the emitter layer 44. In the case where the emitter connection layer 43 is made of semiconductor material such as Si or Ge, the resistance of the emitter connection layer 43 presents an excessive current resulting from the emission of electrons at an excessive rate.

DESCRIPTION OF THE THIRD PREFERRED EMBODIMENT

Figure 22:
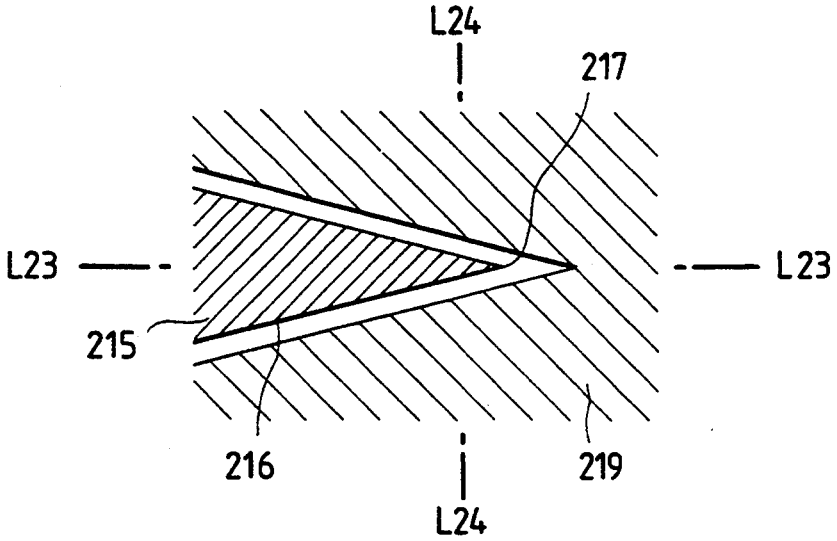
FIG. 22 is a sectional view of an electron emission element according to a third embodiment of this invention.
Figure 23:
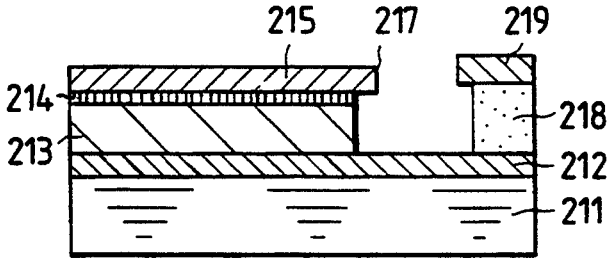
FIG. 23 is a sectional view of the electron emission element, taken along the line L23—L23 of FIG. 22.
Figure 24:
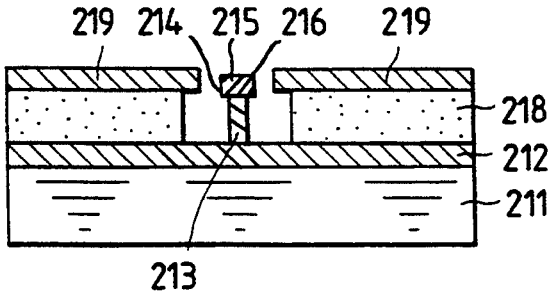
FIG. 24 is a sectional view of the electron emission element, taken along the line L24—L24 of FIG. 22.

With reference to FIGS. 22–24, an electron emission element includes a substrate 211 made of insulating material such as glass, $Al_2O_3$, or $SiO_2$. A layer of a base electrode 212 is formed on the substrate 211. The base electrode 212 is made of suitable material such as Al, Cr, Pt, $In_2O_3$, or Ta. A first emitter connection layer 213 is formed on a given area of the base electrode 212. The first emitter connection layer 213 is made of suitable material such as Pt, C, Si, or Ge. A second emitter connection layer 214 is superposed on the first emitter connection layer 213. The second emitter connection layer 214 is made of suitable material such as Al, Cr, or Au. An emitter layer 215 is superposed on the second emitter connection layer 214. The emitter layer 215 and the base electrode 212 are electrically connected via the first and second emitter connection layers 213 and 214. Thus, a current can flow from the base electrode 212 to the emitter layer 215 via the first and second emitter connection layers 213 and 214. The emitter layer 215 is made of suitable material such as Mo, W, ZrC, or $LaB_6$ which has a low work function and a high melting point.

The first and second emitter connection layers 213 and 214 have a crisscross shape, having four wedge projections with tips which are spaced by equal angular intervals. Each of the projections of the first and second emitter connection layers 213 and 214 has a rectangular or trapezoidal cross-section. Each of the projections of the first and second emitter connection layers 213 and 214 is tapered at a fixed rate, having a horizontal width which linearly decreases from a given value to zero in the direction from the center of the crisscross shape to the related tip.

The emitter layer 215 has a crisscross shape similar to and slightly greater than the crisscross shape of the first and second emitter connection layers 213 and 214. The emitter layer 215 has four wedge projections with tips which are spaced by equal angular intervals. Each of the projections of the emitter layer 215 has a rectangular or trapezoidal cross-section. Each of the projections of the emitter layer 215 is tapered at a fixed rate, having a horizontal width which linearly decreases from a given value to zero in the direction from the center of the crisscross shape to the related tip. As best shown in FIG. 24, each of the projections of the emitter layer 215 has two edges 216 which slightly extend outward from the first and second emitter connection layers 213 and 214. The two edges 216 of each projection of the emitter layer 215 intersect and terminate at a vertex or tip 217. As best shown in FIG. 23, each tip 217 extends outward from the first and second emitter connection layers 213 and 214.

An insulating layer 218 is formed on a given area of the base electrode 212. The insulating layer 218 is horizontally spaced from the emitter layer 215 by a given gap. Specifically, the insulating layer 218 is provided with a recess having a crisscross shape similar to and slightly greater than the crisscross shape of the emitter layer 215, and the emitter layer 215 is located in the recess of the insulating layer 218. The recess of the insulating layer 218 has tapered portions conforming to the tapered projections of the emitter layer 215. The insulating layer 218 is made of suitable material such as $SiO_2$, $Al_2O_3$, or $Si_3N_4$. The insulating layer 218 has a thickness approximately equal to the sum of the thicknesses of the first and second emitter connection layers 213 and 214. A layer of a control electrode 219 is superposed on the insulating layer 218. The control electrode 219 has a crisscross opening with tapered portions conforming to the tapered projections of the emitter layer 215. The control electrode 219 is made of metal such as Mo, W, Cr, or Nb. The control electrode 219 functions to help the emission of electrons from the emitter layer 215. As shown in FIGS. 23 and 24, edges of the control electrode 219 slightly extend outward from the insulating layer 218.

Figure 25:
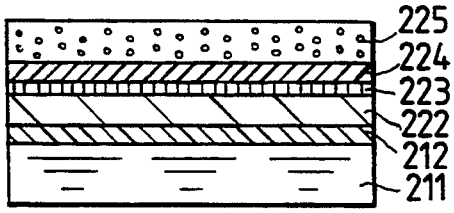
FIGS. 25–31 are sectional views of a substrate and various layers thereon at different phases of the fabrication of the electron emission element of FIGS. 22–24.
Figure 26:
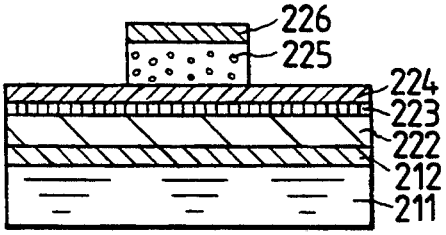
Figure 27:
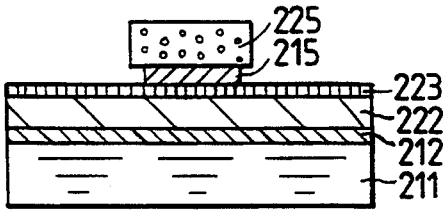
Figure 28:
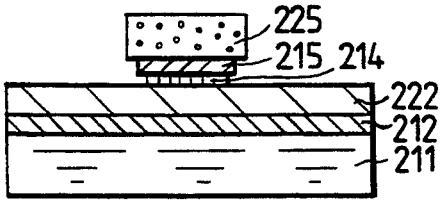
Figure 29:
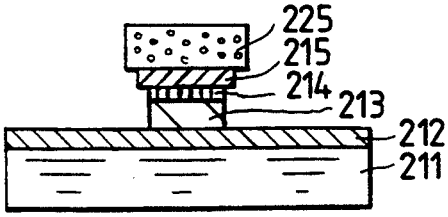
Figure 30:
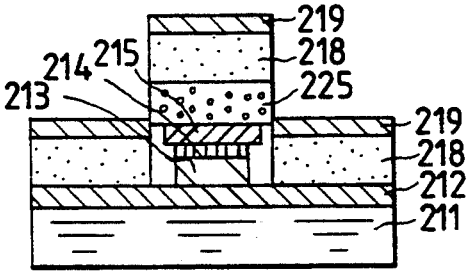
Figure 31:
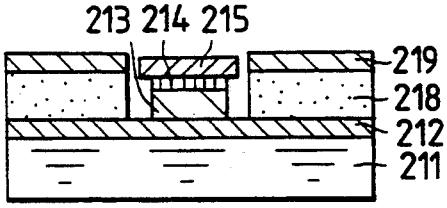

The electron emission element of FIGS. 22–24 was fabricated as follows. First, as shown in FIG. 25, a substrate 211 made of suitable material such as glass, $Al_2O_3$, or $SiO_2$ was prepared. Then, a film of a base electrode 212, a first emitter connection film 222, a second emitter connection film 223, an emitter film 224, and a mask layer 225 were sequentially formed on the substrate 211 by a suitable method such as a vacuum vapor deposition method, a sputtering vapor deposition method, or an electron-beam vapor deposition method. The base electrode film 212 was made of suitable material such as Al, Cr, $In_2O_3$, or Ta. The base electrode film 212 had a thickness in the range of 200 to 300 nm. The first emitter connection film 222 was made of suitable material such as Pt, C, Si, or Ge. The first emitter connection film 222 had a thickness in the rage of 500 nm to 1 μm. The second emitter connection film 223 was made of suitable material such as Al, Cr, or Au. The second emitter connection film 223 had a thickness of about 100 nm. The emitter film 224 was made of suitable material such as Mo, W, ZrC, or $LaB_6$. The emitter layer 224 had a thickness in the range of 100 to 300 nm. The mask layer 225 was made of suitable material such as Al or $SiO_2$. The mask layer 225 had a thickness in the range of 0.5 to 1.5 μm. Subsequently, as shown in FIG. 26, a resist 226 was formed on the mask layer 225 by a general lithography technique. The resist 226 had a pattern similar to and slightly greater than the shape of a final emitter layer 215. The portions of the mask layer 225 which were uncovered from the resist 226 were removed by an etching process while the resist 226 was used as a mask. The resist 226 was removed. Then, as shown in FIG. 27, the emitter film 224 was made into a shape similar to and slightly smaller than the shape of the remainder of the mask layer 225 by a reactive ion etching process using, for example, $CF_4$-based gas. During this etching process, the remainder of the mask layer 225 was used as a mask member. Specifically, the shape of the remainder of the emitter film 224 was smaller than the pattern of the remainder of the mask layer 225 by about 1 μm. The remainder of the emitter film 224 constituted the final emitter layer 215. It is preferable that the second emitter connection film 223 was made of material able to withstand the $CF_4$-based gas. Subsequently, as shown in FIG. 28, the second emitter connection film 223 was made into a shape similar to and slightly smaller than the shape of the final emitter layer 215 by an etching process using, for example, $Cl_2$-based gas. As a result, the second emitter connection film 223 was processed into a final second emitter connection layer 214. The second emitter connection film 223 was provided to protect the first emitter connection film 222 from the etching process on the emitter film 224. The thickness of the second emitter connection film 223 was preferably chosen so as to enable the etching process thereon to be completed in a short time. It is preferable that the emitter film 224 was made of material able to withstand the $Cl_2$-based gas. Next, as shown in FIG. 29, the first emitter connection film 222 was made into a shape essentially equal to the shape of the second emitter connection layer 214 by an etching process using, for example, $CF_4$-based gas. As a result, the first emitter connection film 222 was processed into a final first emitter connection layer 213. The speed of etching the material forming the first emitter connection film 222 was sufficiently higher than the speed of etching the material forming the final emitter layer 215. Thus, during the etching process on the first emitter connection film 222, the emitter layer 215 remained essentially unchanged In shape. It was experimentally confirmed that the speed of etching a vapor-deposition Si film was equal to ten times the speed of etching a vapor-deposition Mo film, and was equal to five times the speed of etching a vapor-deposition W film. Subsequently, as shown in FIG. 30, an insulating layer 218 and a layer of a control electrode 219 were sequentially formed on the exposed portions of the above-mentioned layers on the substrate 211 by a suitable method such as a vapor deposition method. The insulating layer 218 was made of suitable material such as $SiO_2$, $Al_2O_3$, or $Si_3N_4$. The layer of the control electrode 219 was made of metal such as Mo, W, or Cr. Finally, as shown in FIG. 31, the remainder of the mask layer 225, and the portions of the insulating layer 218 and the control electrode layer 219 extending thereon were removed so that the emitter layer 215 was exposed. The remainders of the insulating layer 218 and the control electrode layer 219 were horizontally spaced from the emitter layer 215 by a given gap.

The electron emission element of FIGS. 22–24 operates as follows. In the case where a voltage is applied between the emitter layer 215 and the control electrode 219 via the base electrode 212 and the first and second emitter connection layers 213 and 214 in a manner such that the emitter layer 215 is subjected to a negative potential relative to the control electrode 219, lines of an electric force are concentrated on the tip 217 of each projection of the emitter layer 215 so that a strong electric field is applied to the tip 217. When the strength of the electric field applied to the tip 217 exceeds a given strength, electrons are emitted from the tip 217 due to the tunnel effect.

As described previously, there are provided the first and second emitter connection layers 213 and 214. For the attainment of desired processing of the respective layers, it is preferable to select an optimal combination of the materials forming the emitter layer 215 and the first and second emitter connection layers 213 and 214. The speed of etching the material forming the first emitter connection film 222 is sufficiently higher than the speed of etching the material forming the final emitter layer 215, and the second emitter connection film 223 is made of material able to withstand the etching process on the emitter film 224. This design enables the easy formation of a sharp structure of the tips 217 of the emitter layer 215. In the case where the first and second emitter connection layers 213 and 214 are made of semiconductor materials, the resistaces of the first and second emitter connection layers 213 and 214 present an excessive current resulting from the emission of electrons at an excessive rate.

DESCRIPTION OF THE FOURTH PREFERRED EMBODIMENT

Figure 32:
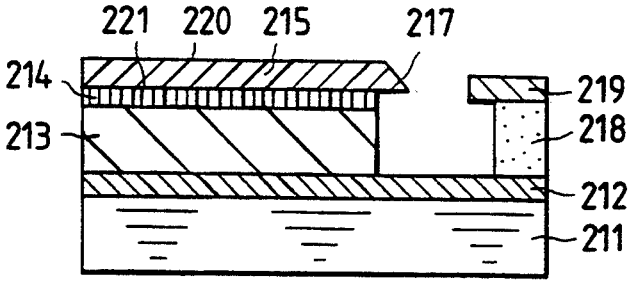
FIG. 32 is a sectional view similar to that of FIG. 23 and shows an electron emission element according to a fourth embodiment of this invention.
Figure 33:
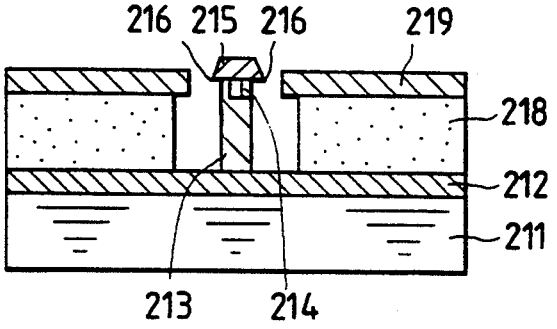
FIG. 33 is a sectional view similar to that of FIG. 24 and shows the electron emission element according to the fourth embodiment.

A fourth embodiment of this invention is similar to the embodiment of FIGS. 22–31 except for design changes indicated hereinafter. With reference to FIGS. 32 and 33, in an electron emission element according to the fourth embodiment, the cross-section of each of projections of an emitter layer 215 has such a mesa shape that an upper horizontal dimension is smaller than a lower horizontal dimension. As best shown in FIG. 33, each of the projections of the emitter layer 215 has two edges 216 which slightly extend outward from first and second emitter connection layers 213 and 214 and which have lower corners of a given acute angle in cross-section. The two edges 216 of each projection of the emitter layer 215 intersect and terminate at a vertex or tip 217 having a lower corner of a given acute angle. As best shown in FIG. 32, a lower part of each tip 217 extends outward from the first and second emitter connection layers 213 and 214.

Figure 34:
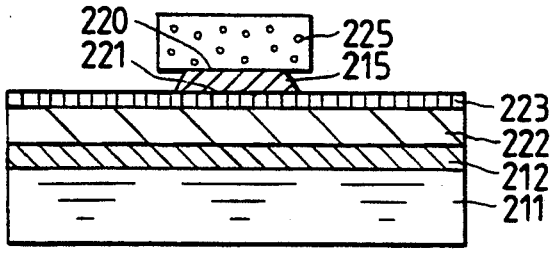
FIGS. 34–37 are sectional views of a substrate and various layers thereon at different phases of the fabrication of the electron emission element of FIGS. 32 and 33.
Figure 35:
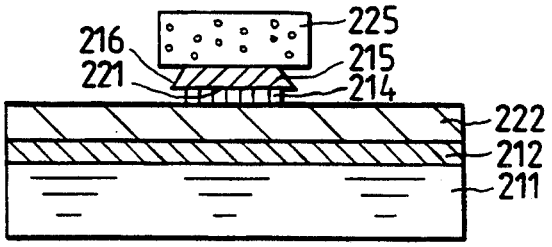
Figure 36:
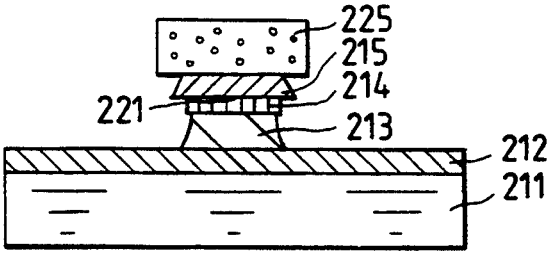
Figure 37:
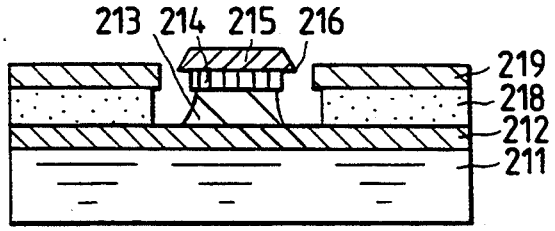

During the fabrication of the electron emission element of FIGS. 32 and 33, as shown in FIG. 34, an emitter film 224 (see FIGS. 25 and 26) was made into a shape similar to and slightly smaller than the shape of the remainder of a mask layer 225 by a reactive ion etching process using, for example, $CF_4$-based gas. In this etching process, the remainder of the mask layer 225 was used as a mask member. As a result, the emitter film 224 was processed into a final emitter layer 215. The etching process was kept in isotropic conditions so that the cross-section of the final emitter layer 215 had a mesa shape in which an upper horizontal dimension was smaller than a lower horizontal dimension. In addition, the final emitter layer 215 was formed with edges 216 which had lower corners of a given acute angle in cross-section. Also, the final emitter layer 215 was formed with tips 217 (see FIG. 32) each having a lower corner of a given acute angle. It is preferable that a second emitter connection film 223 was made of material able to withstand the $CF_4$-based gas. Subsequently, as shown in FIG. 35, the second emitter connection film 223 was made into a shape similar to and slightly smaller than the shape of the lower surface 221 of the final emitter layer 215 by an etching process using, for example, $Cl_2$-based gas. As a result, the second emitter connection film 223 was processed into a final second emitter connection layer 214. It is preferable that the emitter layer 215 was made of material able to withstand the $Cl_2$-based gas. Next, as shown in FIG. 36, the first emitter connection film 222 was made into a shape slightly smaller than the shape of the lower surface 221 of the final emitter layer 215 by an etching process using, for example, $CF_4$-based gas. As a result, the first emitter connection film 222 was processed into a final first emitter connection layer 213. The speed of etching the material forming the first emitter connection film 222 was sufficiently higher than the speed of etching the material forming the final emitter layer 215. Thus, in the etching process on the first emitter connection film 222, the emitter layer 215 remained essentially unchanged in shape. Subsequently, as shown in FIG. 37, an insulating layer 218 and a layer of a control electrode 219 were sequentially formed on the exposed portions of the abovementioned layers on the substrate 211 by a suitable method such as a vapor deposition method. Finally, the remainder of the mask layer 225, and the portions of the insulating layer 218 and the control electrode layer 219 extending thereon were removed so that the emitter layer 215 was exposed. The remainders of the insulating layer 218 and the control electrode layer 219 were horizontally spaced from the emitter layer 215 by a given gap.

As described previously, the cross-section of each of the projections of the emitter layer 215 has a mesa shape, and the tip 217 of each projection of the emitter layer 215 has the lower acute-angle corner. According to this design of the emitter layer 215, a larger number of lines of an electric force can be concentrated on the lower acute-angle corner of each tip 217 so that the electron emission element can operate at a lower applied voltage and that the electron emission characteristics can be improved.

DESCRIPTION OF THE FIFTH PREFERRED EMBODIMENT

Figure 38:
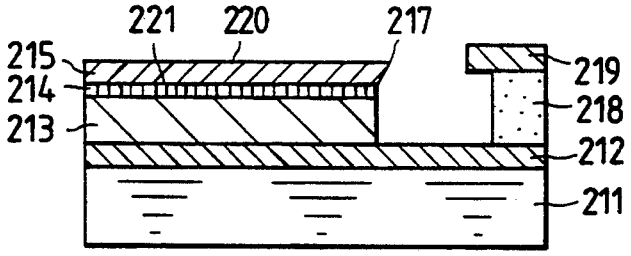
FIG. 38 is a sectional view similar to that of FIG. 23 and shows an electron emission element according to a fifth embodiment of this invention.
Figure 39:
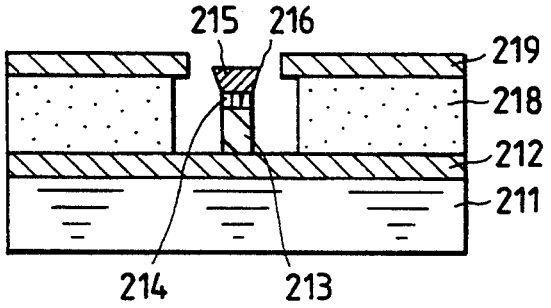
FIG. 39 is a sectional view similar to that of FIG. 24 and shows the electron emission element according to the fifth embodiment.

A fifth embodiment of this invention is similar to the embodiment of FIGS. 22–31 except for design changes indicated hereinafter. With reference to FIGS. 38 and 39, in an electron emission element according to the fifth embodiment, the cross-section of each of projections of an emitter layer 215 has such an inverted-mesa shape that an upper horizontal dimension is larger than a lower horizontal dimension. As best shown in FIG. 39, each of the projections of the emitter layer 215 has two edges 216 which slightly extend outward from first and second emitter connection layers 213 and 214 and which have upper corners of a given acute angle in cross-section. The two edges 216 of each projection of the emitter layer 215 intersect and terminate at a vertex or tip 217 having an upper corner of a given acute angle. As best shown in FIG. 38, an upper part of each tip 217 extends outward from the first and second emitter connection layers 213 and 214.

Figure 40:
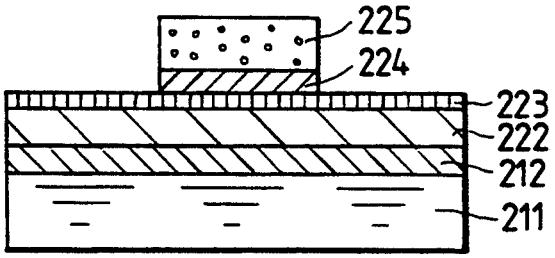
FIGS. 40–43 are sectional views of a substrate and various layers thereon at different phases of the fabrication of the electron emission element of FIGS. 38 and 39.
Figure 41:
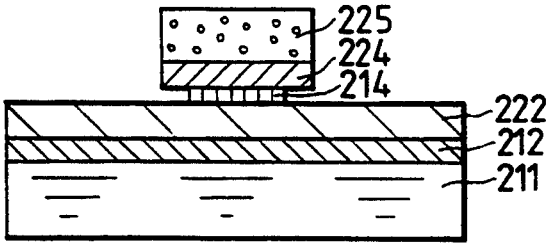
Figure 42:
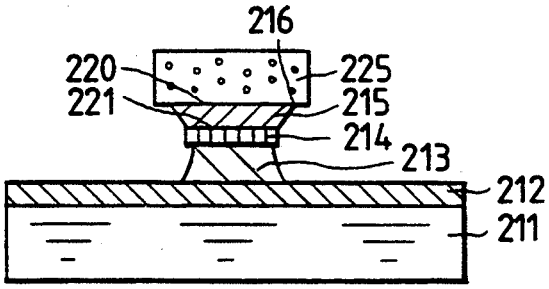
Figure 43:
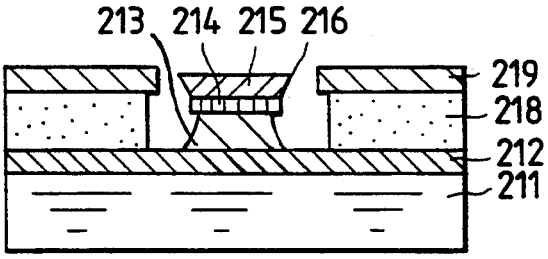

During the fabrication of the electron emission element of FIGS. 38 and 39, as shown in FIG. 40, an emitter film 224 was made into a shape essentially equal to the shape of the remainder of a mask layer 225 by a reactive ion etching process using, for example, $CF_4$-based gas. In this etching process, the remainder of the mask layer 225 was used as a mask member. The etching process was kept in anisotropic conditions so that the side surfaces of the remainder of the emitter film 224 extended vertically. It is preferable that a second emitter connection film 223 was made of material able to withstand the $CF_4$-based gas. Subsequently, as shown in FIG. 41, the second emitter connection film 223 was made into a shape similar to and appreciably smaller than the shape of the remainder of the emitter film 224 by an etching process using, for example, $Cl_2$-based gas. As a result, the second emitter connection film 223 was processed into a final second emitter connection layer 214. It is preferable that the emitter film 224 was made of material able to withstand the $Cl_2$-based gas. Next, as shown in FIG. 42, the first emitter connection film 222 was made into a shape slightly smaller than the shape of the remainder of the emitter film 224 by an etching process using, for example, $CF_4$-based gas. As a result, the first emitter connection film 222 was processed into a final first emitter connection layer 213. The speed of etching the material forming the first emitter connection film 222 was higher than the speed of etching the material forming the emitter film 224. The material of the emitter film 224 was chosen so that the remainder of the emitter film 224 was slightly reduced in the etching process on the first emitter connection film 222. Thus, the remainder of the emitter film 224 was processed into a final emitter layer 215. The cross-section of the final emitter layer 215 had such an inverted-mesa shape that an upper horizontal dimension 220 was larger than a lower horizontal dimension 221. In addition, the final emitter layer 215 was formed with edges 216 which had upper corners of a given acute angle in cross-section. Also, the final emitter layer 215 was formed with tips 217 (see FIG. 38) each having an upper corner of a given acute angle. Subsequently, as shown in FIG. 43, an insulating layer 218 and a layer of a control electrode 219 were sequentially formed on the exposed portions of the above-mentioned layers on the substrate 211 by a suitable method such as a vapor deposition method. Finally, the remainder of the mask layer 225, and the portions of the insulating layer 218 and the control electrode layer 219 extending thereon were removed so that the emitter layer 215 was exposed. The remainders of the insulating layer 218 and the control electrode layer 219 were horizontally spaced from the emitter layer 215 by a given gap.

As described previously, the cross-section of each of the projections of the emitter layer 215 has an inverted-mesa shape, and the tip 217 of each projection of the emitter layer 215 has the upper acute-angle corner. According to this design of the emitter layer 215, a larger number of lines of an electric force can be concentrated on the upper acute-angle corner of each tip 217 so that the electron emission-element can operate at a lower applied voltage and that the electron emission characteristics can be improved.

DESCRIPTION OF THE SIXTH PREFERRED EMBODIMENT

Figure 44:
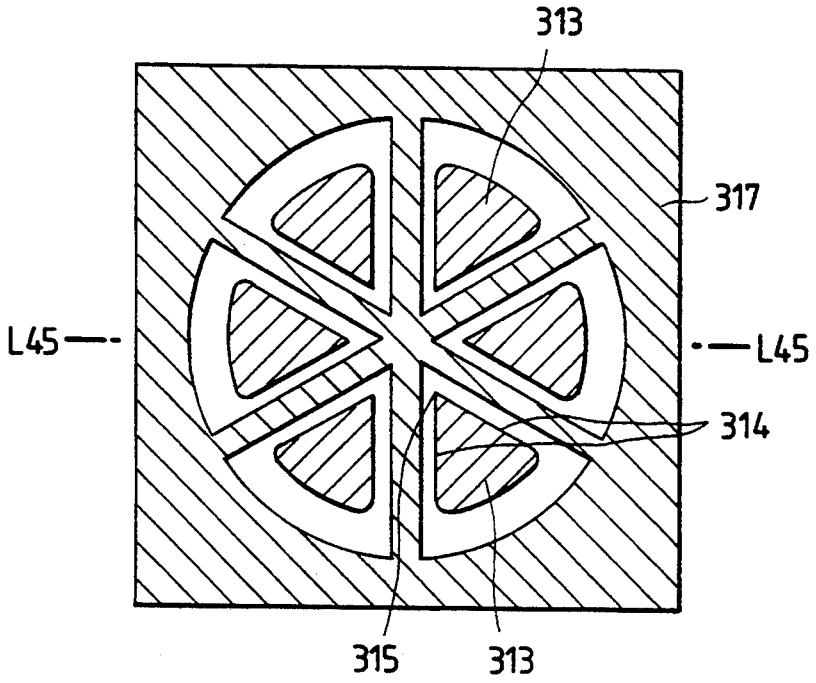
FIG. 44 is a sectional view of an electron emission element according to a sixth embodiment of this invention.
Figure 45:
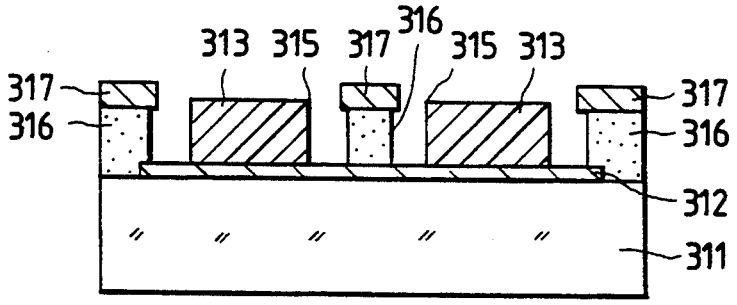
FIG. 45 is a sectional view of the electron emission element, taken along the line L45—L45 of FIG. 44.

With reference to FIGS. 44 and 45, an electron emission element includes a substrate 311 made of insulating material such as glass or ceramics. A layer of a base electrode 312 is formed on the substrate 311. The base electrode 312 is made of suitable material such as Al, Au, Mo, Cr, or Ta. Emitters 313 having a common shape of a wedge or sector are formed on a given region of the base electrode 312. The emitters 313 are made of suitable material such as Mo, W, ZrC, or $LaB_6$. The emitters 313 are angularly spaced, and the tips 315 of the wedges of the emitters 313 face a common central point. In other words, the emitters 313 are arranged radially with respect to the central point. Each of the emitters 313 has a horizontal width which decreases from a given value to zero in the radial direction toward the central point. In other words, each of the emitters 313 has a tapered design.

An insulating layer 316 made of suitable material such as $SiO_2$, $Al_2O_3$, or $Si_3N_4$ is formed on the substrate 311 and the base electrode 312. The insulating layer 316 surrounds the emitters 313, and is horizontally spaced from the emitters 313 by a given gap. Specifically, the insulating layer 316 has recesses of a shape which is similar to and greater than the shape of the emitters 313, and the recesses accommodate the emitters 313 respectively. A layer of a control electrode 317 is superposed on the insulating layer 316. Thus, the control electrode 317 has openings having a shape which is similar to and greater than the shape of the emitters 313, and the emitters 313 extend in the openings respectively. The openings of the control electrode 317 have a tapered design corresponding to the tapered design of the emitters 313. The control electrode 317 is made of metal such as Cr, Mo, or W. The control electrode 317 functions to help the emission of electrons from the emitters 313.

The electron emission element of FIGS. 44 and 45 operates as follows. When a voltage is applied between the emitters 313 and the control electrode 317 via the base electrode 312 in a manner such that the emitters 313 are subjected to a negative potential relative to the control electrode 317, lines of an electric force are concentrated on the tip 315 of each of the emitters 313 so that a strong electric field is applied to the tip 315. The strong electric field applied to the tip 315 of each emitter 313 forces electrons to be emitted from the tip 315.

Computer simulation shows that the directions of the lines of the electric force have components equal to the directions of the tips 315 of the wedges of the emitters 313. Since the directions of the tips 315 of the emitters 313 face the previously-mentioned common central point, the electrons emitted from the tips 315 move toward the central point as viewed in a horizontal plane. Thus, a resultant beam of the electrons emitted from the respective tips 315 is prevented from expanding outwardly, and maintains a good quality.

The tapered design of the emitters 313 and the corresponding tapered design of the control electrode 317 ensure that a variation in the accuracy of the patterns of the emitters 313 and the control electrode 317 can be compensated and thus stable electron emission characteristics can be always maintained.

Figure 46:
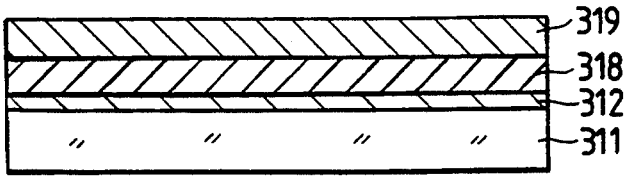
FIGS. 46–50 are sectional views of a substrate and various layers thereon at different phases of the fabrication of the electron emission element of FIGS. 44 and 45.

The electron emission element of FIGS. 44 and 45 was fabricated as follows. First, as shown in FIG. 46, an insulating substrate 311 made of suitable material such as glass was prepared, and a film of a base electrode 312 which had a given thickness was formed on the insulating substrate 311 by a suitable method such as a vacuum vapor deposition method or a sputtering method. The base electrode 312 was made of electrically conductive material such as Al, Ta, or Cr. Subsequently, an emitter film 318 having a given thickness was formed on the base electrode film 312 by a method similar to the method of the formation of the base electrode film 312. The emitter film 318 was made of suitable material such as Mo, W, ZrC, or TiC. In addition, a layer of lift-off material 319 was formed on the emitter film 318 by a method similar to the methods of the formation of the base electrode film 312 and the emitter film 318. In this way, the emitter film 318 was coated with the lift-off material layer 319. The lift-off material layer 319 had a given thickness greater than the thickness of an insulating layer 316 described later. The lift-off material layer 319 was composed of metal or insulating material, being able to withstand a later etching process and being prevented from corroding the other materials or films during later fabrication steps.

Figure 47:
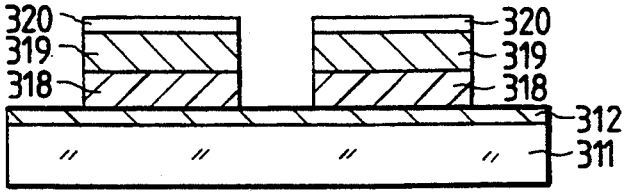
Figure 48:
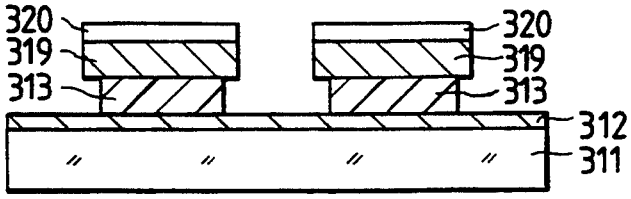

Subsequently, as shown In FIG. 47, a photoresist 320 having a pattern corresponding to a desired pattern of semifinished emitters 313 was formed on the lift-off material member 319. The lift-off material member 319 and the emitter film 318 were subjected to an etching process while the photoresist 320 was used as a protective film. As a result, semifinished emitters 313 having a desired configuration and a desired shape were obtained. In addition, the lift-off material member 319 was processed into separated segments corresponding to the semifinished emitters 313. Next, as shown in FIG. 48, the semifinished emitters 313 were etched into shapes slightly smaller than the shapes of the corresponding lift-off material segments 319.

Figure 49:
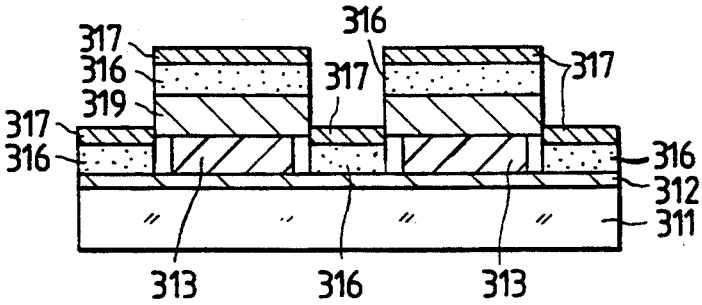

Subsequently, as shown In FIG. 49, the photoresist 320 was removed, and then layers of insulating material 316 and layers of a control electrode 317 were sequentially formed on the entire region of the upper surfaces of the substrate by a sputtering method. In order to enhance the characteristics of close contact between the base electrode 312 and the insulating layer 316 and close contact between the insulating layer 316 and the control electrode layer 317, it was preferable to heat the whole of the substrate. Before the heating process, the photoresist 320 was removed as described previously to prevent the occurrence of the fact that the photoresist 320 would be decomposed and thereby could contaminated the other materials or films during the heating process.

Figure 50:
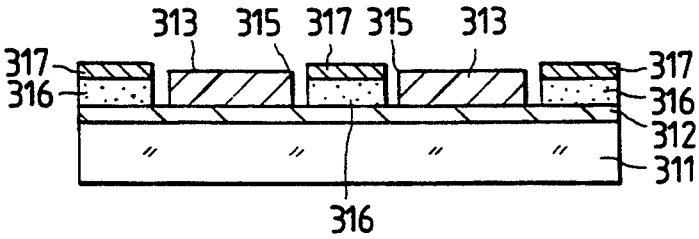

Finally, as shown in FIG. 50, the lift-off material segments 319, and the insulating layers 316 and the control electrode layers 317 extending on the lift-off material segments 319 were removed so that the emitters 313 were exposed.

DESCRIPTION OF THE SEVENTH PREFERRED EMBODIMENT

Figure 51:
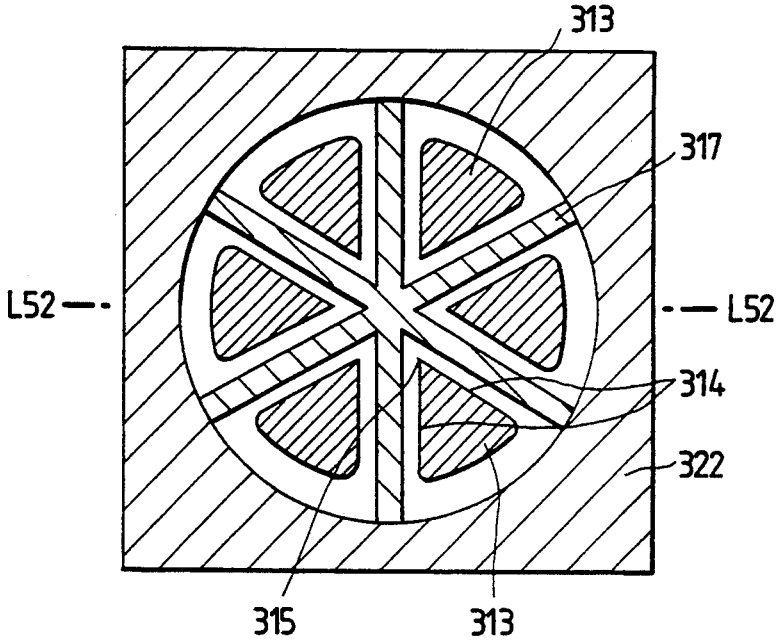
FIG. 51 is a sectional view of an electron emission element according to a seventh embodiment of this invention.
Figure 52:
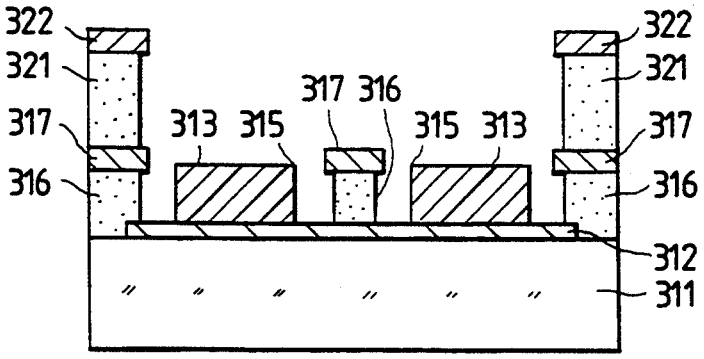
FIG. 52 is a sectional view of the electron emission element, taken along the line L52—L52 of FIG. 51.

With reference to FIGS. 51 and 52, an electron emission element includes a substrate 311 made of insulating material such as glass or ceramics. A layer of a base electrode 312 is formed on the substrate 311. The base electrode 312 is made of suitable material such as Al, Au, Mo, Cr, or Ta. Emitters 313 having a common shape of a wedge or sector are formed on a given region of the base electrode 312. The emitters 313 are made of suitable material such as Mo, W, ZrC, or $LaB_6$. The emitters 313 are angularly spaced, and the tips 315 of the wedges of the emitters 313 face a common central point. In other words, the emitters 313 are arranged radially with respect to the central point. Each of the emitters 313 has a horizontal width which decreases from a given value to zero in the radial direction toward the central point. In other words, each of the emitters 313 has a tapered design.

An insulating layer 316 made of suitable material such as $SiO_2$, $Al_2O_3$, or $Si_3N_4$ is formed on the substrate 311 and the base electrode 312. The insulating layer 316 surrounds the emitters 313, and is horizontally spaced from the emitters 313 by a given gap. Specifically, the insulating layer 316 has recesses of a shape which is similar to and greater than the shape of the emitters 313, and the recesses accommodate the emitters 313 respectively. A layer of a control electrode 317 is superposed on the insulating layer 316. Thus, the control electrode 317 has openings having a shape which is similar to and greater than the shape of the emitters 313, and the emitters 313 extend in the openings respectively. The openings of the control electrode 317 have a tapered design corresponding to the tapered design of the emitters 313. The control electrode 317 is made of metal such as Cr, Mo, or W. The control electrode 317 functions to help the emission of electrons from the emitters 313.

An insulating layer 321 is formed on the portion of the control electrode 317 which extends outward of the emitters 313. A control electrode 322 is formed on the insulating layer 321. The control electrode 322 is in a position axially and upwardly spaced from the position of the control electrode 317. The control electrode 322 extends radially outward of the emitters 313.

The electron emission element of FIGS. 51 and 52 operates as follows. When a voltage is applied between the emitters 313 and the control electrode 317 via the base electrode 312 in a manner such that the emitters 313 are subjected to a negative potential relative to the control electrode 317, lines of an electric force are concentrated on the tip 315 of each of the emitters 313 so that a strong electric field is applied to the tip 315. The strong electric field applied to the tip 315 of each emitter 313 forces electrons to be emitted from the tip 315.

Computer simulation shows that the directions of the lines of the electric force have components equal to the directions of the tips 315 of the wedges of the emitters 313. Since the directions of the tips 315 of the emitters 313 face the previously-mentioned common central point, the electrons emitted from the tips 315 move toward the central point as viewed in a horizontal plane. Thus, a resultant beam of the electrons emitted from the respective tips 315 is prevented from expanding outwardly, and maintains a good quality.

The control electrode 322 is electrically biased so that the electron beam can be further condensed.

The tapered design of the emitters 313 and the corresponding tapered design of the control electrode 317 ensure that a variation in the accuracy of the patterns of the emitters 313 and the control electrode 317 can be compensated and thus stable electron emission characteristics can be always maintained.

DESCRIPTION OF THE EIGHTH PREFERRED EMBODIMENT

Figure 53:
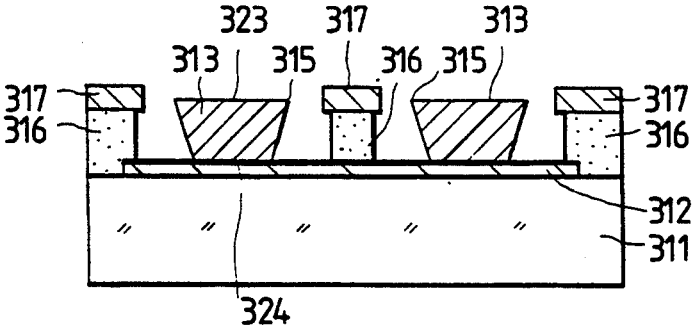
FIG. 53 is a sectional view similar to that of FIG. 45 and shows an electron emission element according to an eighth embodiment of this invention.

An eighth embodiment of this invention is similar to the embodiment of FIGS. 44–50 except for design changes indicated hereinafter. With reference to FIG. 53, in an electron emission element according to the eighth embodiment, the cross-section of each of emitters 313 has such an inverted-mesa shape that an upper horizontal dimension is larger than a lower horizontal dimension. Thus, each of the emitters 313 has a larger upper surface 323 and a smaller lower surface 324. Each of the tips 315 of the emitters 313 is of a tapered structure having an upper projecting portion. Each of the tips 315 of the emitters 313 has an upper corner or vertex of a given acute angle in cross-section.

The electron emission element of FIG. 53 operates as follows. In the case where a voltage is applied between each emitter 313 and the control electrode 317 via a base electrode 312 in a manner such that the emitter 313 is subjected to a negative potential relative to the control electrode 317, lines of an electric force are concentrated on the upper acute-angle corner of the tip 315 of the emitter 313 so that a strong electric field is applied to the upper acute-angle corner of the tip 315. When the strength of the electric field applied to the upper acute-angle corner of the tip 315 exceeds a given strength, electrons are emitted from the upper acute-angle corner of the tip 315 due to the tunnel effect.

As described previously, the cross-section of each of the emitters 313 has an inverted-mesa shape, and the tip 315 of each of the emitters 313 has the upper acute-angle corner. According to this design of the emitters 313, a larger number of lines of an electric force can be concentrated on the upper acute-angle corner of each tip 315 so that the electron emission element can operate at a lower applied voltage and that the electron emission characteristics can be improved.

Figure 54:
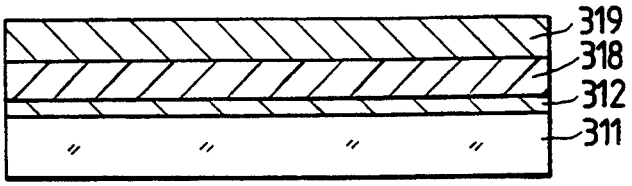
FIGS. 54–58 are sectional views of a substrate and various layers thereon at different phases of the fabrication of the electron emission element of FIG. 53.

The electron emission element of FIG. 53 was fabricated as follows. First, as shown in FIG. 54, an insulating substrate 311 made of suitable material such as glass was prepared, and a film of a base electrode 312 which had a given thickness was formed on the insulating substrate 311 by a suitable method such as a vacuum vapor deposition method or a sputtering method. The base electrode 312 was made of electrically conductive material such as Cr, Ta, or $In_2O_3$. Subsequently, an emitter film 318 having a given thickness was formed on the base electrode film 312 by a method similar to the method of the formation of the base electrode film 312. The emitter film 318 was made of suitable material such as Mo or W. In addition, a layer of lift-off material 319 was formed on the emitter film 318 by a method similar to the methods of the formation of the base electrode film 312 and the emitter film 318. In this way, the emitter film 318 was coated with the lift-off material layer 319. The lift-off material layer 319 had a given thickness greater than the thickness of an insulating layer 316 described later. The lift-off material layer 319 was composed of metal or insulating material, being able to withstand a later etching process and being prevented from corroding the other materials or films during later fabrication steps. Specifically, the lift-off material layer 319 was made of Al, Sn, Ti, $SiO_2$, or others.

Figure 55:
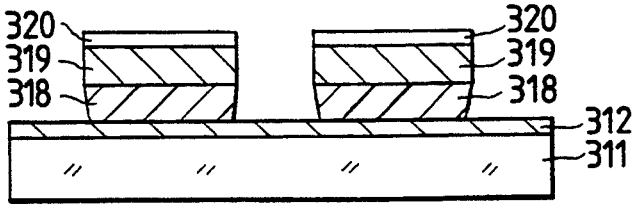
Figure 56:
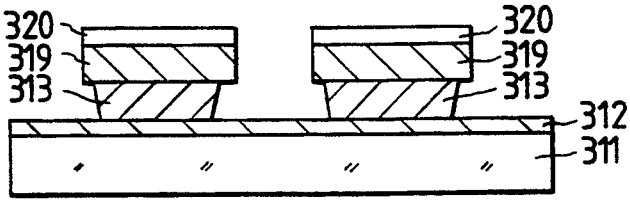

Subsequently, as shown in FIG. 55, a photoresist 320 having a pattern similar to and slightly larger than a desired pattern of finished emitters 313 was formed on the lift-off material member 319. The lift-off material member 319 and the emitter film 318 were subjected to an etching process while the photoresist 320 was used as a protective film. As a result, the lift-off material member 319 and the emitter film 318 were made into a pattern corresponding to the pattern of the photoresist 320. The remainder of the lift-off material member was composed of separated segments, and also the the remainder of the emitter film 318 was composed of separated segments. Then, while the remainder of the lift-off material member 319 was used as a mask, the remainder of the emitter film 318 was subjected to a reactive ion etching process kept in anisotropic conditions. During this etching process, ionized radical molecules were obliquely applied to the surfaces of the remainder of the emitter film 318 while the substrate 311 was rotated. Thereby, the remainder of the emitter film 318 was made into an inverted-mesa structure. Subsequently, the remainder of the emitter film 318 was subjected to a reactive ion etching process kept in isotropic conditions. Thus, as shown in FIG. 56, the remainder of the emitter film 318 was processed into final emitters 313 having a pattern slightly smaller than the pattern of the remainder of the lift-off material member 319.

Figure 57:
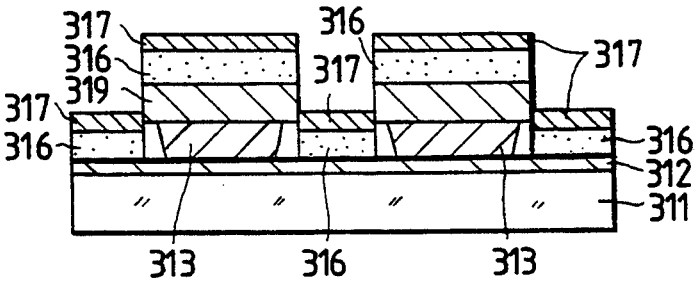
Figure 58:
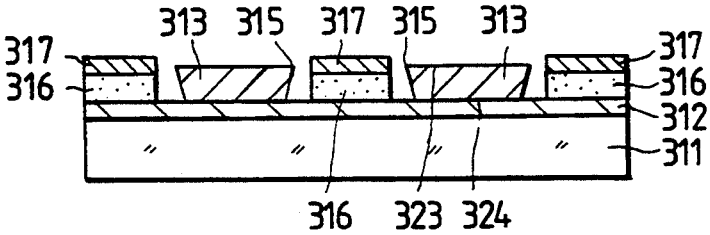

Next, as shown in FIG. 57, the photoresist 320 was removed, and then layers of insulating material 316 and layers of a control electrode 317 were sequentially formed on the entire region of the upper surfaces of the substrate by a suitable method such as a vacuum vapor deposition method or a sputtering method. Finally, as shown in FIG. 58, the lift-off material segments 319, and the insulating layers 316 and the control electrode layers 317 extending on the lift-off material segments 319 were removed so that the emitters 313 were exposed.

DESCRIPTION OF THE NINTH PREFERRED EMBODIMENT

Figure 59:
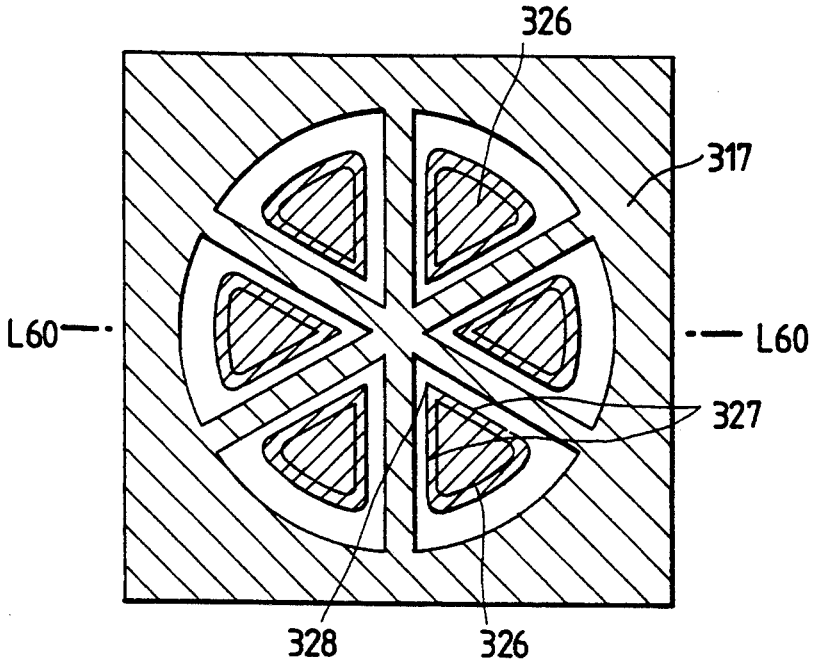
FIG. 59 is a sectional view of an electron emission element according to a ninth embodiment of this invention.
Figure 60:
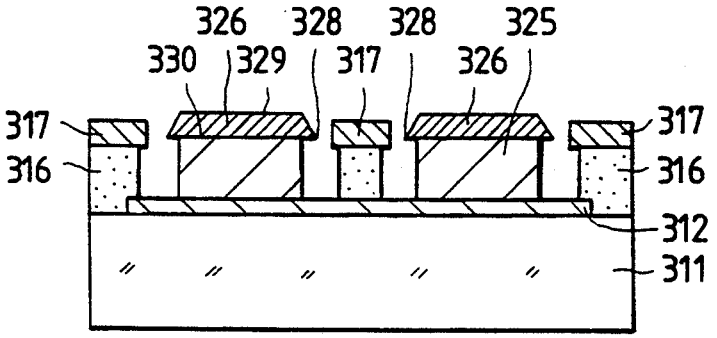
FIG. 60 is a sectional view of the electron emission element, taken along the line L60—L60 of FIG. 59.

With reference to FIGS. 59 and 60, an electron emission element includes a substrate 311 made of insulating material such as glass or ceramics. A layer of a base electrode 312 is formed on the substrate 311. The base electrode 312 is made of suitable material such as Al, Au, Mo, Cr, or Ta. Emitter connection layers 325 having a common shape of a wedge or sector are formed on given regions of the base electrode 312. The emitter connection layers 325 are made of suitable material such as Au, Cr, C, Si, or Ge. Emitters 326 are superposed on the emitter connection layers 325 respectively. The emitters 326 has a common shape of a wedge or sector which is slightly greater than the shape of the emitter connection layers 325. The emitters 326 are made of suitable material such as Mo, W, ZrC, or $LaB_6$. The emitters 326 are angularly spaced, and the tips 328 of the wedges of the emitters 326 face a common central point. In other words, the emitters 326 are arranged radially with respect to the central point. Each of the emitters 326 has a horizontal width which decreases from a given value to zero In the radial direction toward the central point. In other words, each of the emitters 326 has a tapered design.

The cross-section of each of the emitters 326 has such a mesa shape that an upper horizontal dimension is smaller than a lower horizontal dimension. Thus, each of the emitters 326 has a larger upper surface 329 and a smaller lower surface 330. In addition, each of the emitters 326 has edges 327 which slightly extend outward from the emitter connection layer 325 and which have lower corners of a given acute angle in cross-section. Two edges 327 of each of the emitters 326 intersect and terminate at a vertex or tip 328 having a lower corner of a given acute angle. A lower part of each tip 328 extends outward from the emitter connection layer 325.

An insulating layer 316 made of suitable material such as $SiO_2$, $Al_2O_3$, or $Si_3N_4$ is formed on the substrate 311 and the base electrode 312. The insulating layer 316 surrounds the emitter connection layers 325, and is horizontally spaced from the emitter connection layers 325 by a given gap. Specifically, the insulating layer 316 has recesses of a shape which is similar to and greater than the shape of the emitter connection layers 325, and the recesses accommodate the emitter connection layers 325 respectively. A layer of a control electrode 317 is superposed on the insulating layer 316. The control electrode 317 has openings of a shape which is similar to and greater than the shape of the emitters 326, and the emitters 326 extend in the openings respectively. The openings of the control electrode 317 have a tapered design corresponding to the tapered design of the emitters 326. The control electrode 317 is made of metal such as Cr, Mo, or W. The control electrode 317 functions to help the emission of electrons from the emitters 326.

The electron emission element of FIGS. 59 and 60 operates as follows. In the case where a voltage is applied between the emitters 326 and the control electrode 317 via the base electrode 312 and the emitter connection layers 325 in a manner such that the emitters 326 are subjected to a negative potential relative to the control electrode 317, lines of an electric force are concentrated on the lower acute-angle corner of the tip 328 of each emitter 326 so that a strong electric field is applied to the lower acute-angle corner of the tip 328. When the strength of the electric field applied to the lower acute-angle corner of the tip 328 exceeds a given strength, electrons are emitted from the lower acute-angle corner of the tip 328 due to the tunnel effect.

As described previously, the cross-section of each of the emitters 326 has a mesa shape, and the tip 328 of each emitter 326 has the lower acute-angle corner. According to this design of the emitters 326, a larger number of lines of an electric force can be concentrated on the lower acute-angle corner of each tip 328 so that the electron emission element can operate at a lower applied voltage and that the electron emission characteristics can be improved.

Computer simulation shows that the directions of the lines of the electric force have components equal to the directions of the tips 328 of the wedges of the emitters 326. Since the directions of the tips 328 of the emitters 326 face the previously-mentioned common central point, the electrons emitted from the tips 328 move toward the central point as viewed in a horizontal plane. Thus, a resultant beam of the electrons emitted from the respective tips 328 is prevented from expanding outwardly, and maintains a good quality.

The tapered design of the emitters 326 and the corresponding tapered design of the control electrode 317 ensure that a variation in the accuracy of the patterns of the emitters 326 and the control electrode 317 can be compensated and thus stable electron emission characteristics can be always maintained.

Figure 61:
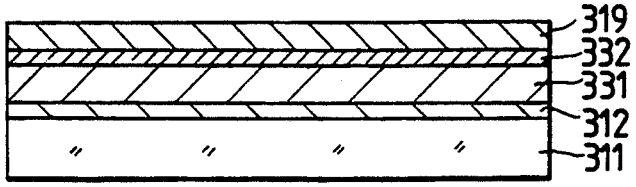
FIGS. 61–65 are sectional views of a substrate and various layers thereon at different phases of the fabrication of the electron emission element of FIGS. 59 and 60.
Figure 62:
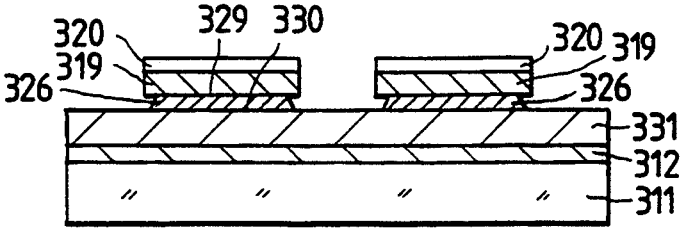
Figure 63:
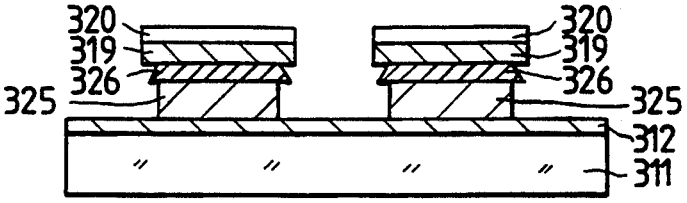
Figure 64:
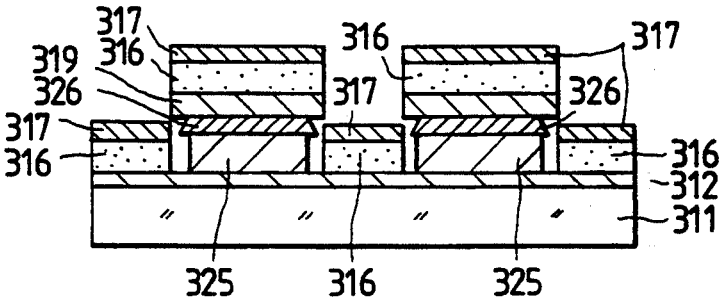
Figure 65:
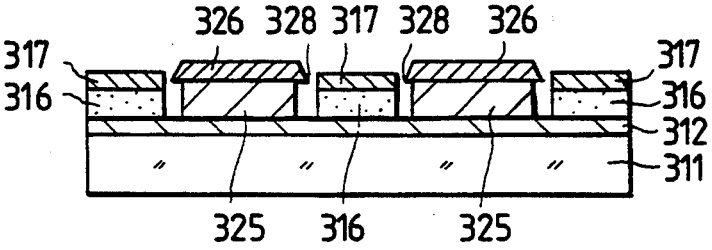

The electron emission element of FIGS. 59 and 60 was fabricated as follows. First, as shown in FIG. 61, a substrate 311 made of suitable material such as glass, $Al_2O_3$, or ceramics was prepared. Then, a film of a base electrode 312, an emitter connection film 331, an emitter film 332, and a lift-off material layer 319 were sequentially formed on the substrate 311 by a suitable method such as a vapor deposition method or a sputtering method. The base electrode film 312 was made of suitable material such as Cr, Pt, $In_2O_3$, or Ta. The emitter connection film 331 was made of suitable material such as Au, C, Cr, Si, or Ge. The emitter film 332, was made of suitable material such as Mo or W. The lift-off material layer 319 was made of suitable material such as Al or $SiO_2$. Subsequently, as shown in FIG. 62, a photoresist 320 was formed on the lift-off material layer 319 by a general lithography technique. The photoresist 320 had a pattern similar to and slightly greater than the pattern of final emitters 326. The portions of the lift-off material layer 319 which were uncovered from the photoresist 320 were removed by an etching process while the photoresist 320 was used as a mask. Then, the emitter film 332 was made into a pattern slightly smaller than the pattern of the remainder of the lift-off material layer 319 by a reactive ion etching process using, for example, $CF_4$-based gas. During this etching process, the remainder of the lift-off material layer 319 was used as a mask member. As a result, the emitter film 332 was processed into separated final emitters 326. The etching process was kept in isotropic conditions so that the cross-section of the final emitters 326 had a mesa shape in which an upper horizontal dimension was smaller than a lower horizontal dimension. Thus, each of the final emitters 326 had a smaller upper surface 329 and a larger lower surface 330. In addition, each of the final emitters 326 was formed with edges 327 (see FIG. 59) which had lower corners of a given acute angle in cross-section. Also, each of the final emitters 326 was formed with a tip 328 (see FIGS. 59 and 60) each having a lower corner of a given acute angle. It is preferable that the emitter connection film 331 was made of material able to withstand the $CF_4$-based gas. Subsequently, as shown in FIG. 63, the emitter connection film 331 was made into a pattern slightly smaller than the pattern of the final emitters 326 by an etching process using, for example, $Cl_2$-based gas. During this etching process, the remainder of the lift-off material layer 319 and the final emitters 326 were used as a mask member. As a result, the emitter connection film 331 was processed into separated final emitter connection layers 325. The edges 327 and the tip 328 (see FIGS. 59 and 60) of each final emitter 326 extended outward from the related final emitter connection layer 13. It is preferable that the emitter connection film 332 was made of material able to withstand the $Cl_2$-based gas. Next, as shown in FIG. 64, the photoresist 320 was removed, and an insulating layer 316 and a layer of a control electrode 317 were sequentially formed on the exposed portions of the above-mentioned layers on the substrate 311 by a suitable method such as a vapor deposition method. The insulating layer 316 was made of suitable material such as $SiO_2$, $Al_2O_3$, or $Si_3N_4$. The layer of the control electrode 317 was made of metal such as Mo, W, Cr, or Nb. Finally, as shown in FIG. 65, the remainder of the lift-off material layer 319, and the portions of the insulating layer 316 and the control electrode layer 317 extending thereon were removed so that the final emitters 326 were exposed. The remainders of the insulating layer 316 and the control electrode layer 317 were horizontally spaced from the final emitters 326 by a given gap.

As described previously, the emitters 326 are made of suitable material such as Mo, W, ZrC, or $LaB_6$ while the emitter connection layers 325 are made of suitable material such as Au, Cr, C, Si, or Ge which differs from the material constituting the emitters 326. This choice of the materials constituting the emitters 326 and the emitter connection layers 325 enables the easy formation of a sharp structure of the edges 327 of the emitters 326. In the case where the emitter connection layers 325 are made of semiconductor material such as Si or Ge, the resistance of the emitter connection layers 325 presents an excessive current resulting from the emission of electrons at an excessive rate.

DESCRIPTION OF THE TENTH PREFERRED EMBODIMENT

Figure 66:
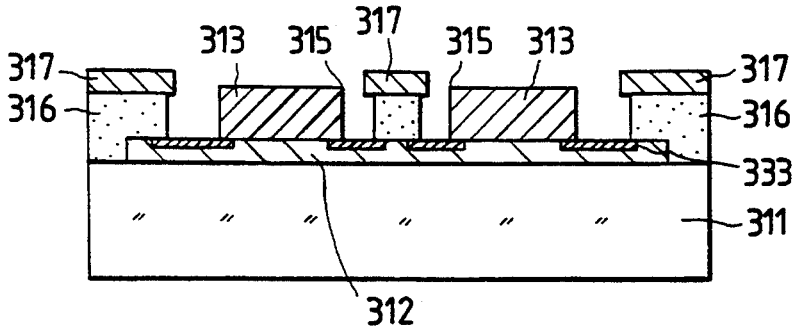
FIG. 66 is a sectional view similar to that of FIG. 45 and shows an electron emission element according to a tenth embodiment of this invention.

FIG. 66 shows a tenth embodiment of this invention which is similar to the embodiment of FIGS. 44–50 except for the following additional design.

In the embodiment of FIG. 66, the upper surface of a base electrode 312 which extends around emitters 313 is coated with an insulating layer 333. The insulating layer 333 suppresses a leak current to or from the surface of the base electrode 312, enabling a higher rating voltage between the base electrode 312 and a control electrode 317.

DESCRIPTION OF THE ELEVENTH PREFERRED EMBODIMENT

Figure 67:
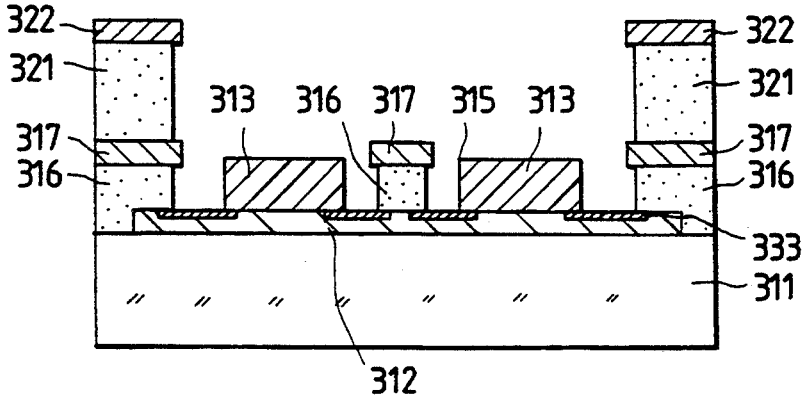
FIG. 67 is a sectional view similar to that of FIG. 45 and shows an electron emission element according to an eleventh embodiment of this invention.

FIG. 67 shows an eleventh embodiment of this invention which is similar to the embodiment of FIGS. 51 and 52 except for the following additional design.

In the embodiment of FIG. 67, the upper surface of a base electrode 312 which extends around emitters 313 is coated with an insulating layer 333. The insulating layer 333 suppresses a leak current to or from the surface of the base electrode 312, enabling a higher rating voltage between the base electrode 312 and a control electrode 317.

What is claimed is:

1. An electron emission element comprising:

a substrate;

a base electrode formed on the substrate;

an emitter connecting portion formed on a part of the base electrode and being electrically conductive;

an emitter formed on the emitter connecting portion and having a wedge, the wedge having a mesa shape in section, the wedge having an upper surface and a lower surface which is wider than the upper surface, the wedge having an edge which has a lower corner of an acute angle in section;

an insulating layer formed on the substrate and spaced from the wedge of the emitter by a given gap; and a control electrode formed on the insulating layer for enabling electrons to be emitted from the edge of the emitter.

2. The electron emission element of claim 1, wherein the edge of the wedge of the emitter extends outward from the emitter connecting portion.

3. An electron emission element comprising:

a substrate;

a base electrode formed on the substrate;

an emitter connecting portion formed on a part of the base electrode;

an emitter formed on the emitter connecting portion and having a wedge, the wedge having a mesa shape in section, the wedge having an upper surface and a lower surface which is wider than the upper surface, the wedge having an edge which has a lower corner of an acute angle in section;

an insulating layer formed on the substrate and spaced from the wedge of the emitter by a given gap; and a control electrode formed on the insulating layer for enabling electrons to be emitted from the edge of the emitter, wherein the emitter is made of a first electrically-conductive material and the emitter connecting portion is made of a second electrically-conductive material which differs from the first electrically-conductive material.

4. An electron emission element comprising:

a substrate;

a base electrode formed on the substrate;

an emitter connecting portion formed on a part of the base electrode.;

an emitter formed on the emitter connecting portion and having a wedge, the wedge having a mesa shape in section, the wedge having an upper surface and a lower surface which is wider than the upper surface, the wedge having an edge which has a lower corner of an acute angle in section;

an insulating layer formed on the substrate and spaced from the wedge of the emitter by a given gap; and a control electrode formed on the insulating layer for enabling electrons to be emitted from the edge of the emitter, wherein the emitter connecting portion is made of a semiconductor material.

5. An electron emission element comprising:

a substrate;

a base electrode formed on the substrate;

an emitter connecting portion formed on a part of the base electrode;

an emitter formed on the emitter connecting portion and having a wedge, the wedge having a mesa shape in section, the wedge having an upper surface and a lower surface which is wider than the upper surface, the wedge having an edge which has a lower corner of an acute angle in section;

an insulating layer formed on the substrate and spaced from the wedge of the emitter by a given gap; and a control electrode formed on the insulating layer for enabling electrons to be emitted from the edge of the emitter, wherein the emitter connecting portion comprises a first sub portion and a second sub portion formed on the first sub portion, and the first sub portion and the second sub portion are made of different materials respectively.

6. An electron emission element comprising:

a substrate;

a base electrode formed on the substrate;

an emitter connecting portion formed on a part of the base electrode and being electrically conductive;

an emitter formed on the emitter connecting portion and having a wedge, the wedge having an inverted-mesa shape in section, the wedge having an upper surface and a lower surface which is narrower than the upper surface, the wedge having an edge which has an upper corner of an acute angle in section;

an insulating layer formed on the substrate and spaced from the wedge of the emitter by a given gap; and a control electrode formed on the insulating layer for enabling electrons to be emitted from the edge of the emitter.

7. The electron emission element of claim 6, wherein the edge of the wedge of the emitter extends outward from the emitter connecting portion.

8. An electron emission element comprising:

a substrate;

a base electrode formed on the substrate;

an emitter connecting portion formed on a part of the base electrode;

an emitter formed on the emitter connecting portion and having a wedge, the wedge having an inverted-mesa shape in section, the wedge having an upper surface and a lower surface which is narrower than the upper surface, the wedge having an edge which has an upper corner of an acute angle in section;

an insulating layer formed on the substrate and spaced from the wedge of the emitter by a given gap; and a control electrode formed on the insulating layer for enabling electrons to be emitted from the edge of the emitter, wherein the emitter is made of a first electrically-conductive material and the emitter connecting portion is made of a second electrically-conductive material which differs from the first electrically-conductive material.

9. The electron emission element of claim 6, wherein the emitter connecting portion is made of a semiconductor material.

10. An electron emission element comprising:

a substrate;

a base electrode formed on the substrate;

an emitter connecting portion formed on a part of the base electrode;

an emitter formed on the emitter connecting portion and having a wedge, the wedge having an inverted-mesa shape in section, the wedge having an upper surface and a lower surface which is narrower than the upper surface, the wedge having an edge which has an upper corner of an acute angle in section;

an insulating layer formed on the substrate and spaced from the wedge of the emitter by a given gap; and a control electrode formed on the insulating layer for enabling electrons to be emitted from the edge of the emitter, wherein the emitter connecting portion comprises a first sub portion and a second sub portion formed on the first sub portion, and the first sub portion and the second sub portion are made of different materials respectively.

11. An electron emission element comprising:

an insulating substrate;

a base electrode formed on the insulating substrate;

a plurality of emitters formed on the base electrode and arranged radially with respect to a given point, the emitters having respective wedges facing inward;

an insulating layer formed on the substrate and the base electrode and spaced from the wedges of the emitters by given gaps; and a control electrode formed on the insulating layer for enabling electrons to be emitted from the wedges of the emitters;

wherein each of the wedges has a mesa shape in section, and each of the wedges has an upper surface and a lower surface which is wider than the upper surface, and wherein each of the wedges has an edge which has a lower corner of an acute angle in section.

12. The electron emission element of claim 11, wherein the wedges of the emitters face a common central point.

13. Art electron emission element comprising:

an insulating substrate;

a base electrode formed on the insulating substrate;

a plurality of emitters formed on the base electrode and arranged radially with respect to a given point, the emitters having respective wedges facing inward;

an insulating layer formed on the substrate and the base electrode and spaced from the wedges of the emitters by given gaps; and a control electrode formed on the insulating layer for enabling electrons to be emitted from the wedges of the emitters;

wherein each of the wedges has an inverted-mesa shape in section, and each of the wedges has an upper surface and a lower surface which is narrower than the upper surface, and wherein each of the wedges has an edge which has an upper corner of an acute angle in section.

14. The electron emission element of claim 13, wherein the wedges of the emitters face a common central point.

15. An electron emission element comprising:

a substrate;

a base electrode formed on the substrate;

a first emitter connecting portion formed on a part of the base electrode;

a second emitter connecting portion formed on the first emitter connecting portion, wherein the first emitter connecting portion and the second emitter connecting portion are made of different materials respectively;

an emitter formed on the second emitter connecting portion and having a wedge;

an insulating layer formed on the substrate and spaced from the wedge of the emitter by a given gap; and a control electrode formed on the insulating layer for enabling electrons to be emitted from the emitter.

16. The electron emission element of claim 15, wherein the emitter is made of a first electrically-conductive material and the first emitter connecting portion is made of a second electrically-conductive material which differs from the first electrically-conductive material.

17. The electron emission element of claim 15, wherein the first emitter connecting portion is made of a semiconductor material.

18. The electron emission element of claim 15, wherein the emitter is made of a first electrically-conductive material and the second emitter connecting portion is made of a second electrically-conductive material which differs from the first electrically-conductive material.

19. The electron emission element of claim 15, wherein the second emitter connecting portion is made of a semiconductor material.

20. An electron emission element comprising:

an insulating substrate;

a base electrode formed on the insulating substrate;

a plurality of emitter connecting portions formed on parts of the base electrode and being electrically conductive;

a plurality of emitters formed on the emitter connecting portions respectively and arranged radially with respect to a given point, the emitters being spaced in a circumferential direction about the given point and having respective wedges facing inward;

an insulating layer formed on the substrate and the base electrode and spaced from the wedges of the emitters by given gaps; and a control electrode formed on the insulating layer for enabling electrons to be emitted from the wedges of the emitters;

wherein each of the wedges has a mesa shape in section, and each of the wedges has an upper surface and a lower surface which is wider than the upper surface, and wherein each of the wedges has an edge which has a lower corner of an acute angle in section.

21. The electron emission element of claim 11, wherein the emitters are spaced in a circumferential direction about the given point.

22. The electron emission element of claim 13, wherein the emitters are spaced in a circumferential direction about the given point.

* * * * *